US007329991B2

(12) United States Patent
Miyashita et al.

(10) Patent No.: US 7,329,991 B2
(45) Date of Patent: Feb. 12, 2008

(54) PLASMA DISPLAY PANEL PROVIDED WITH THINNED CRYSTAL PHOSPHOR MATERIAL AND ITS CORRESPONDING METHOD OF MANUFACTURING

(75) Inventors: Kanako Miyashita, Mishima-gun (JP); Hiroyuki Kado, Ibaraki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 303 days.

(21) Appl. No.: 10/451,546

(22) PCT Filed: Jan. 15, 2002

(86) PCT No.: PCT/JP02/00170

§ 371 (c)(1),
(2), (4) Date: Dec. 8, 2003

(87) PCT Pub. No.: WO02/058095

PCT Pub. Date: Jul. 25, 2002

(65) Prior Publication Data

US 2004/0075375 A1 Apr. 22, 2004

(30) Foreign Application Priority Data

Jan. 17, 2001 (JP) ..... 2001-008478

(51) Int. Cl.
*H01J 17/49* (2006.01)
*H01J 9/00* (2006.01)

(52) U.S. Cl. ..... 313/587; 313/586; 313/582; 313/485; 313/486; 445/24; 427/64; 427/69

(58) Field of Classification Search ..... 313/582–587; 445/24

See application file for complete search history.

(56) References Cited

U.S. PATENT DOCUMENTS

| | | | | |
|---|---|---|---|---|
| 4,791,336 | A * | 12/1988 | Morimoto et al. | 313/496 |
| 5,227,097 | A | 7/1993 | Brandner et al. | |
| 5,804,919 | A * | 9/1998 | Jacobsen et al. | 313/506 |
| 5,932,967 | A * | 8/1999 | Chikazawa | 313/582 |
| 6,184,849 | B1 * | 2/2001 | Stoller | 345/72 |
| 6,411,032 | B1 | 6/2002 | Shiiki et al. | |
| 6,611,099 | B1 * | 8/2003 | Murata et al. | 313/582 |
| 6,774,562 | B2 * | 8/2004 | Roche et al. | 313/582 |
| 6,838,825 | B2 | 1/2005 | Shiiki et al. | |
| 2002/0089284 | A1 * | 7/2002 | Hayashi | 313/582 |

FOREIGN PATENT DOCUMENTS

| | | |
|---|---|---|
| EP | 0945890 A1 | 9/1999 |
| JP | 2-132731 | 5/1990 |
| JP | 2-230634 | 9/1990 |
| JP | 4-47640 | 2/1992 |

(Continued)

*Primary Examiner*—Nimeshkumar D. Patel
*Assistant Examiner*—Anne M Hines

(57) ABSTRACT

A plasma display panel operated at a high luminous efficiency even with a fine cell structure and its manufacturing method. An AC type PDP1 has a phosphor film 31 comprising a thinned crystal over the surface of a dielectric protecting film 14 in a front panel 10 The phosphor film 31 is a film formed by EB evaporation, the film thickness of which is set in a range where a sufficient luminous efficiency and a visible light penetration efficiency can be secured when the phosphor film 31 is irradiated with ultraviolet rays.

60 Claims, 16 Drawing Sheets

FOREIGN PATENT DOCUMENTS

| | | | |
|---|---|---|---|
| JP | 4-249033 | | 9/1992 |
| JP | 7-312177 | | 11/1995 |
| JP | 09129139 | A | 5/1997 |
| JP | 11-213892 | | 6/1999 |
| JP | 11-297212 | | 10/1999 |
| JP | 2000-11885 | | 1/2000 |
| JP | 2000-77003 | | 3/2000 |
| JP | 2000208058 | A | 7/2000 |
| JP | 2000230173 | A | 8/2000 |
| JP | 2000-294151 | | 10/2000 |

* cited by examiner

PLASMA DISPLAY PANEL PROVIDED WITH THINNED CRYSTAL PHOSPHOR MATERIAL AND ITS CORRESPONDING METHOD OF MANUFACTURING

TECHNICAL FIELD

The present invention relates to a plasma display panel and a method for manufacturing the same.

BACKGROUND ART

Plasma display panels (hereinafter referred to as PDPs) are roughly categorized into two types: a DC type and an AC type. The mainstream of today's PDP is the AC type that is suitable for manufacturing large-size PDPs.

FIG. 16 is a partially sectioned perspective view, illustrating an example of AC type PDPs.

As shown in FIG. 16, a plurality of display electrodes 62 are disposed in stripes on a surface of a front glass substrate 61. A dielectric layer 63 is formed so as to cover the surface of the front glass substrate 61 and the display electrodes 62. Further, a dielectric protecting film 64 is formed over the dielectric layer 63.

On the other hand, a plurality of address electrodes 72 are disposed in stripes on a surface of a back glass substrate 71. The surface on which the address electrodes 72 are disposed faces the front glass substrate 61. The address electrodes 72 are disposed so as to become orthogonal with the display electrodes 62 when the front glass substrate 61 and the back glass substrate 71 are positioned facing each other. A dielectric layer 73 is formed so as to cover the surface of the back glass substrate 71 and the address electrodes 72. Further, on the dielectric layer 73, a plurality of barrier ribs 75 are disposed in parallel to the address electrodes 72, extending toward the front glass substrate 61.

A part surrounded by the dielectric layer 73 and two adjacent barrier ribs 75 is a groove, and phosphor layers 76 are disposed on inner walls of each groove. The phosphor layers 76 in the each grove are one of red phosphor layers 76R, green phosphor layers 76G, and blue phosphor layers 76B. The phosphor layers 76 are made of phosphor particles formed through a thick film formation process, such as screen printing, ink-jet, and photo resisting.

A discharge space is formed by the groove and the dielectric layer 64 when the front glass substrate 61 and the back glass substrate 71 having the above described constructions are positioned so as to face each other. A discharge gas is enclosed in the discharge space 77.

The AC type PDP having the above construction emits light based on basically the same principle as a fluorescent lamp. As discharging of electricity occurs in the discharge space 77, ultraviolet rays emitted from the discharge gas excite the phosphor layers 76 so as to convert the ultraviolet rays into visible light.

Note that the conversion efficiency of each phosphor material used for the phosphor layers 76R, 76G, or 76B is different. The color balance when an image is displayed on a panel is controlled by adjusting the luminance of each of the phosphor layers 76R, 76G, and 76B. Specifically, the luminance of the phosphor layers of other colors is lowered at a specific rate per color in accordance with the luminance of the color having the lowest luminance.

With increasing needs for high quality displays, PDPs having a finer cell structure have been demanded. When cells are made finer, volume of the discharge space 77 becomes smaller and radiation efficiency of the ultraviolet rays decreases. Therefore, it is necessary to further improve the luminous efficiency per cell in order to obtain PDPs having the fine cell structure.

A conventional NTSC has 640×480 cells, and a cell pitch for a 40-inch display of this kind is 0.43 mm×1.29 mm, an area per cell is 0.55 $mm^2$, and the luminance is around 250 $cd/m^2$ ("Function & Materials", Vol. 16, No. 2, page 7, February, 1996, for example).

On the other hand, a high end hi-vision TV has 1920×1125 pixels, and a cell pitch for a 42-inch display of this kind is 0.15 mm×0.48 mm and an area per cell is 0.072 $mm^2$. When a PDP for such a kind of hi-vision TV is manufactured using the conventional method, the radiation efficiency of the ultraviolet rays decreases down to 0.151-0.171 m/W, which is about 1/7 to 1/8 of NTSC. Accordingly, the luminous efficiency of the panel decreases as well.

DISCLOSURE OF THE INVENTION

The present invention is made in order to solve the above noted problem. An object of the present invention is to provide plasma display panels capable of operating at high luminous efficiency even when the cell structure is fine. The present invention also aims to provide methods for manufacturing such plasma display panels.

To this end, a plasma display panel of the present invention comprises a front panel and a back panel facing each other, has a plurality of light emitting cells in a space between the front panel and the back panel, and an area having a crystalline thin film, comprising a thinned crystal made of a phosphor material, is included in at least one of the front panel and the back panel. The area having the crystalline thin film corresponds to at least a part of the light emitting cells.

The above PDP is operable to drive at high luminous efficiency, because the crystalline thin film has better visible light penetration efficiency than phosphor layers of phosphor particles.

Further, it is desirable that the area having the crystalline thin film is included in the front panel.

According to the conventional PDP, a part of the ultraviolet rays is absorbed into the front panel without being used, because a phosphor layer is not formed on the front panel.

On the other hand, in the above PDP, the crystalline thin film comprising the thinned crystal is formed either in or on the front panel at a part corresponding to at least a part of the light emitting cells, and therefore a part of the ultraviolet rays generated in the cell is not absorbed into the front panel, but converged into the visible light and emitted outside of the panel.

In addition, while most of the visible light generated in the cell is blocked if the conventional phosphor layer is formed on the front panel because the visible light penetration efficiency of the conventional phosphor layer is low, the visible light generated in the cell is not blocked when the crystalline thin film is formed in or on the front panel, because the crystalline thin film comprises the thinned crystal made of the phosphor material that has high visible light penetration efficiency.

Accordingly, the luminous efficiency of the above PDP is excellent in comparison with the conventional PDP, and it is appropriate when a fine cell structure is employed.

Generally, a term "thin film" includes amorphous films and films comprising particles. The crystalline thin film comprising the thinned crystal made of the phosphor material in this specification, however, is formed by growing the thin film crystal, and made of a single solid solution. The crystalline thin film is also such that a crystal lattice can be identified therein using a transmission electron microscope (TEM), and a sharp peak is observed when measured using an X-ray diffraction method.

It is preferable to select the phosphor material for the above PDP or set a thickness of the crystalline thin film so that the visible light penetration efficiency of the crystalline thin film becomes at least 85%. When the crystalline thin film is formed on the front panel and the visible light penetration efficiency is less than 85%, a large part of the visible light is blocked, and accordingly, the luminous efficiency of the entire panel decreases.

The visible light penetration efficiency here indicates the visible light penetration efficiency of the crystalline thin film that is formed on the front panel. Specifically, the visible light penetration efficiency is the penetration efficiency with an emission wavelength of the phosphor material. Moreover, the visible light penetration efficiency indicates only the penetration efficiency of the phosphor material, and the penetration efficiency of the substrate or the dielectric layer is not included.

Further, in the above PDP, the crystalline thin film is not necessarily formed on an entire surface of the front panel. For example, it is possible to achieve the effect of the present invention by a plasma display panel such that the front panel having one or two areas each having the crystalline thin film are included in the front panel, and the areas correspond to one or two light emitting cell groups that include red, green, and blue light emitting cell groups. Specifically, the effect is sufficiently achieved by forming the crystalline thin films at an area corresponding to at least one of the blue emitting cell group and the green emitting cell group. The reason why it is possible to achieve the effect of the present invention in a manner described above is that improving the luminance of the blue and green light emitting cell groups increases the luminous efficiency of the entire panel, because it is usually necessary to reduce the luminance of the red light emitting cell group in order to adjust the color balance among the red, green, and blue. Especially, it is effective to form the crystalline thin film at the area corresponding to the blue light emitting cell group.

The same effect can be also achieved by limiting the area on which the crystalline thin films are formed according to the luminance of the light emitting cells.

The phosphor material for the thinned crystal can be the same as or different from a phosphor material used for the phosphor layers of phosphor particles. In a PDP, discharge between display electrodes is caused in a vicinity of a surface of the front panel, within a range of a few μm. A large amount of ionized gas exits in this area, and the surface of the front panel receives a large amount of impacts from electrons and ions. Because the phosphor layer is formed only on the back panel that is remote from the discharge area, an ultraviolet ray excitation type phosphor material has been used for the conventional PDP.

On the other hand, when the crystalline thin film is formed on a top surface of the front panel in the vicinity of the discharge area, not only the ultraviolet excitation type, but an impact excitation type phosphor material can be used. The impact excitation type phosphor material causes light emission by energy of an impact when electrons and ions collide.

The area having the crystalline thin film on the front panel can be either on the surface of the protecting film or between the protecting film and the dielectric layer. In a case in which the crystalline thin film is formed on the surface of the protecting film, it is desirable that the crystalline thin film has cutouts at parts thereof corresponding to the display electrodes. By the cutouts, it is possible to fully utilize the protecting film having a high secondary emission coefficient.

Further, while the crystalline thin film having the cutouts is formed in the above PDP, the same effect can be achieved by forming the crystalline thin film without a cutout on an entire surface of the protecting film. However, a discharge voltage increases slightly because the discharge is interrupted by the crystalline thin film. In order to prevent the interruption, it is effective to form the crystalline thin film on the front panel between the dielectric layer and the protecting film. By doing so, it is possible to prevent the interruption of the discharge and to make the surface area of the crystalline thin film large, and accordingly it is possible to achieve a PDP having higher luminance. Note that it is necessary to use the ultraviolet rays excitation type phosphor material, as in the conventional PDP, because the crystalline thin film is not directly exposed to the discharge space in the above case.

Further, the above PDP may also be such that phosphor layers of phosphor particles are disposed on at least one of the back panel and surfaces of barrier ribs. Even when the phosphor layers are not disposed on one of the back panel and the surfaces of the barrier ribs, the above PDP obtains excellent luminous efficiency in comparison with the conventional PDP. In a case in which the phosphor layers are not formed on the back panel, it is desirable, in terms of the improvement of the luminous efficiency, to form an area, which has a function for reflecting visible light to the front panel, on a surface of the dielectric layer.

The crystalline thin film may also be made of a phosphor material having a different composition from a phosphor material that is used for the phosphor layers. Especially, it is desirable that the crystalline thin film is made of the impact excitation type phosphor material. In this case, it becomes cost effective because the crystal phosphor layers are not formed on the back panel and the barrier ribs, and a number of manufacturing steps can be reduced.

Further, the above PDP may be such that the back panel includes a back substrate, a plurality of electrodes that are disposed on the back substrate, and a dielectric layer that is disposed over the electrodes and the back substrate, and that the dielectric layer is exposed to inner spaces of the light emitting cells without being covered by any of phosphor layers of phosphor particles and the crystalline thin film. The above PDP may also be such that the barrier ribs disposed on the back panel are exposed to the inner spaces of the light emitting cells without being covered by any of the phosphor layers and the crystalline thin film, or that the back panel has either the phosphor layers or the crystalline thin film on surfaces of the barrier ribs corresponding to the light emitting cells.

In a case in which the phosphor layers or the crystalline thin film are not formed on the back panel corresponding to the light emitting cells, it is desirable that an area having 85% or higher visible light reflection efficiency is formed on the back panel. The area having the visible light reflection efficiency of 85% or above may be disposed either on a surface of or inside the dielectric layer.

It is also desirable that the above PDP is such that the front panel includes address electrodes and the back panel includes display electrodes.

Further, a plasma display panel of the present invention is such that a plasma display panel comprises a front panel and a back panel facing each other, and has a plurality of light emitting cells in a space between the front panel and the back panel, that the back panel includes electrodes, and that a crystalline thin film is disposed on the electrodes, with a reflecting area interposed therebetween. The reflecting area has a function for reflecting visible light to the front panel. The crystalline thin film comprises a thinned crystal made of a phosphor material.

The luminous efficiency of the above PDP is further improved because the crystalline thin film, formed by growing the thin film crystal, comprises the thinned crystal made of the phosphor material, and is disposed on a surface of the reflecting area having the function of reflecting visible light. In this case, forming a concave and a convex on the surface of the reflecting area on a side facing the crystalline thin film is more effective, because it is possible to enlarge an effective surface area of the crystalline thin film. It is preferable that the concave and the convex are formed in a way such as a staircase pattern or as a plurality of protrusions. It is more preferable that the effective surface area with the concave and the convex is five times larger than the smooth surface area or more.

The present invention is a method of manufacturing a PDP such that the method of manufacturing a PDP includes a crystalline thin film forming step for forming a crystalline thin film on either one or both of a front panel and a back panel, that the crystalline thin film comprises a thinned crystal made of a phosphor material, and that the crystalline thin film is formed through a vacuum process in a reduced pressure atmosphere in the crystalline thin film forming step.

By the above manufacturing method, it is possible to easily have the crystalline thin film formed by growing the thin film crystal in or on at least one of the front panel and the back panel. Accordingly, it is possible to obtain a PDP having higher luminous efficiency in comparison with the conventional PDP.

One specific example of the vacuum process for film formation is a vapor phase growth method, including a vacuum evaporation method, a spattering method, and a CVD method. It is desirable that the reduced pressure atmosphere under which the film forming step is carried out is containing oxygen or reducing, depending on a composition of the phosphor material used for the formation.

It is desirable the above manufacturing method is such that a manufacturing method includes a step for forming the front panel, that the step for forming the front panel includes a sub-step for forming a protecting film, and that the sub-step for forming the protecting film and the crystalline thin film forming step are carried out successively without any step therebetween. By the above manufacturing method, it is possible to form the both protecting film and the crystalline thin film successively without lowering the substrate temperature, and accordingly, it is possible to obtain excellent crystallinity for the top surface of the film that is exposed to the discharge space.

Especially, in terms of forming a film having excellent crystallinity, it is desirable that the sub-step for forming the protecting film and the crystalline thin film forming step are carried out while the front panel is maintained so as not to be exposed to air.

The above described method enables to reduce expenses for equipment, because individually equipped vacuum apparatuses are not required.

In the above described crystalline thin film forming step, it is desirable that a part where the crystalline thin film is to be formed is heated, because it is possible to increase the crystallinity of the thin film crystal by raising the substrate temperature in the vacuum process for film formation.

Further, the present invention is such that a method of manufacturing a plasma display panel comprises a first step for forming a first phosphor layer on a front panel, and a second step for forming a second phosphor layer on a back panel, and that one of the first step and the second step is a step for forming a crystalline thin film, and another is a step for forming a phosphor layer of phosphor particles. The crystalline thin film comprises a thinned crystal made of a phosphor material.

By the above method, it is possible to obtain a PDP having excellent luminous efficiency in comparison with the conventional PDP, without sacrificing the color balance.

The present invention also includes a PDP manufactured according to the above method, as well as a plasma display device that comprises the PDP manufactured according to the above method and a driving circuit for driving the PDP.

Note that attached drawings and embodiments described in the present specification only show some examples of the present invention. The present invention is not restricted to the drawings and embodiments.

BEST MODE FOR CARRYING OUT THE INVENTION

First Embodiment

1. Overall Structure of Panel

Figure 1:
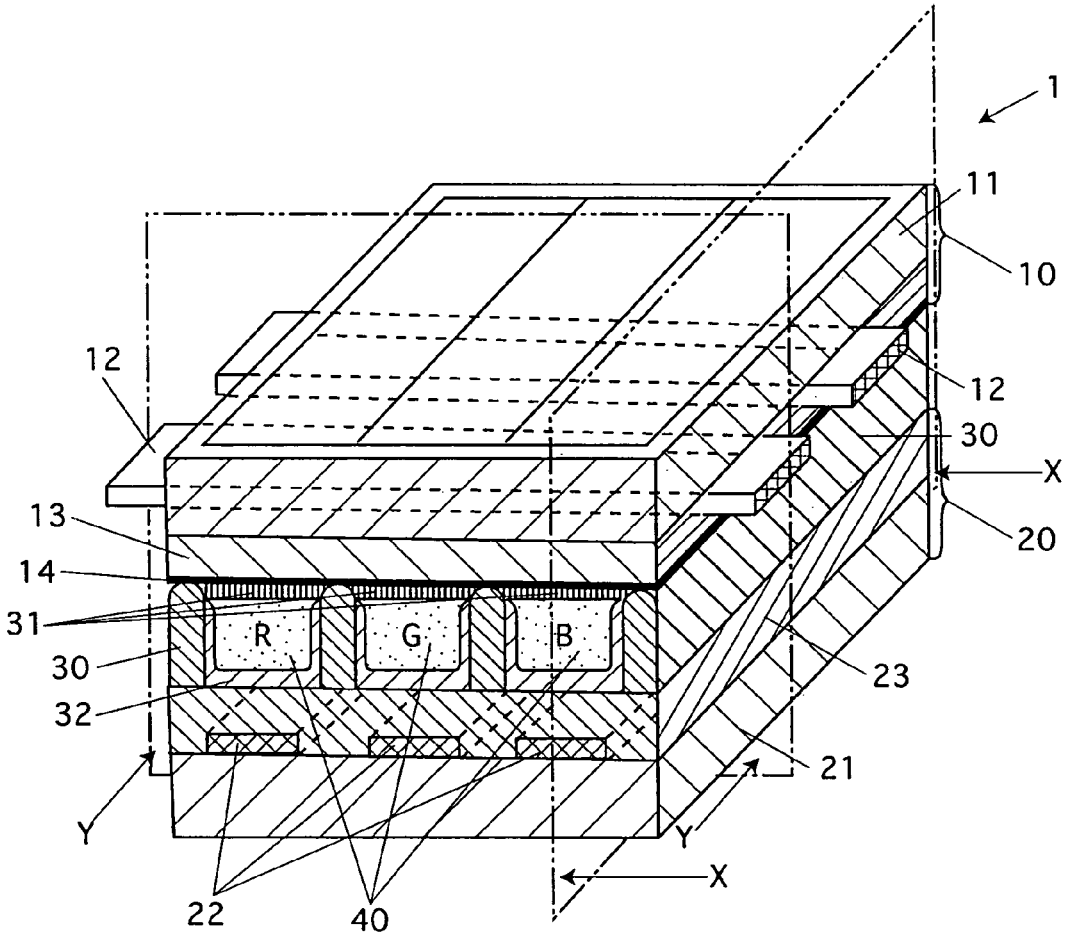
FIG. 1 is a partially sectioned perspective view, illustrating an AC type PDP according to a First Embodiment.

An overall structure of an AC type PDP according to a First Embodiment is explained in accordance with FIG. 1, illustrating a part of the AC type PDP.

As shown in FIG. 1, an AC type PDP 1 has such a structure that a front panel 10 and a back panel 20 are positioned so as to face each other with a space therebetween, and the space between the panels are partitioned by barrier ribs 30 into a plurality of discharge spaces 40.

The front panel 10 has such a structure that a plurality of display electrodes 12 are disposed in stripes on one of main surfaces of a front glass substrate 11, which is the downside surface in the drawing, and a first dielectric layer 13 and a dielectric protecting film 14 are laminated thereon in a stated order.

The back panel 20 has such a structure that a plurality of address electrodes 22 are disposed in stripes on one of main surfaces of a back glass substrate 21, which is the side facing the front panel 10, and a second dielectric layer 23 is formed thereon so as to cover the back glass substrate 21 and the address electrodes 22.

The barrier ribs 30 are disposed on the second dielectric layer 23 of the back panel 20, extending toward the front panel 10. The barrier ribs 30 are each positioned between two adjacent address electrodes 22 in parallel thereto.

The front panel 10 and the back panel 20 face each other so that the display electrodes 12 on the front panel and the address electrodes 22 the back panel 20 are positioned orthogonal to each other. The front panel 10 and the back panel 20 are sealed together with an air-tight sealing layer at circumferences of the panels.

In the discharge spaces 40, a discharge gas, such as an Ne—Xe gas and an He—Xe gas, is enclosed.

Between the glass substrates 11 and 21 of the AC type PDP 1, each intersection part at which the display electrodes 12 and the address electrodes 22 intersects is a light-emitting cell.

A phosphor film 31 is formed on a surface of the dielectric protecting film 14 at an area corresponding to the light-emitting cell, and phosphor layers 32 are formed on surfaces of the barrier ribs 30 and the second dielectric layer 23.

The phosphor layers 32 are thick films of phosphor particles made of single crystal powder, formed by a screen printing method. A thickness of the phosphor layers 32 is approximately the same as a length of 10 phosphor particles lined up.

On the other hand, the phosphor film 31 formed on the front panel 10 is a crystalline thin film comprising a thinned crystal made of a phosphor material, formed by an electron beam (hereinafter referred to as EB) evaporation method which will be explained later. Generally, a term "thin film" includes amorphous films and films comprising particles. The crystalline thin film comprising the thinned crystal made of the phosphor material in this specification, however, is formed by growing the thin film crystal, and is made of a single solid solution. The crystalline thin film is also such that a crystal lattice can be identified therein using a transmission electron microscope (TEM), and a sharp peak, which has a half width of a few degrees or smaller with a θ-2θ method, is observed when measured using an X-ray diffraction method.

Further, a thickness of the phosphor film 31 is set within a range where two conditions are balanced; (a) sufficient luminous efficiency is obtained when ultraviolet rays are irradiated to the phosphor film 31, and (b) sufficient visible light penetration efficiency is ensured. Specifically, it is preferable that the film thickness is in a range of 1-6 μm, and more preferably around 2 μm. Details about the film thickness of the phosphor film 31 will be explained later.

A phosphor material used for the phosphor layer 32 is an ultraviolet excitation type having the following composition.

Red phosphor: $(Y, Gd)BO_3$:Eu

Green phosphor: $Zn_2SiO_4$:Mn

Blue phosphor: $BaMgAl_{10}O_{17}$:Eu

On the other hand, the phosphor material used for the phosphor film 31 is an impact excitation type having the following composition, for example.

Red phosphor: $SnO_2$:Eu

Green phosphor: ZnO:Zn

Blue phosphor: ZnS:Ag

2. Shape of Phosphor Film 31

Figure 2:
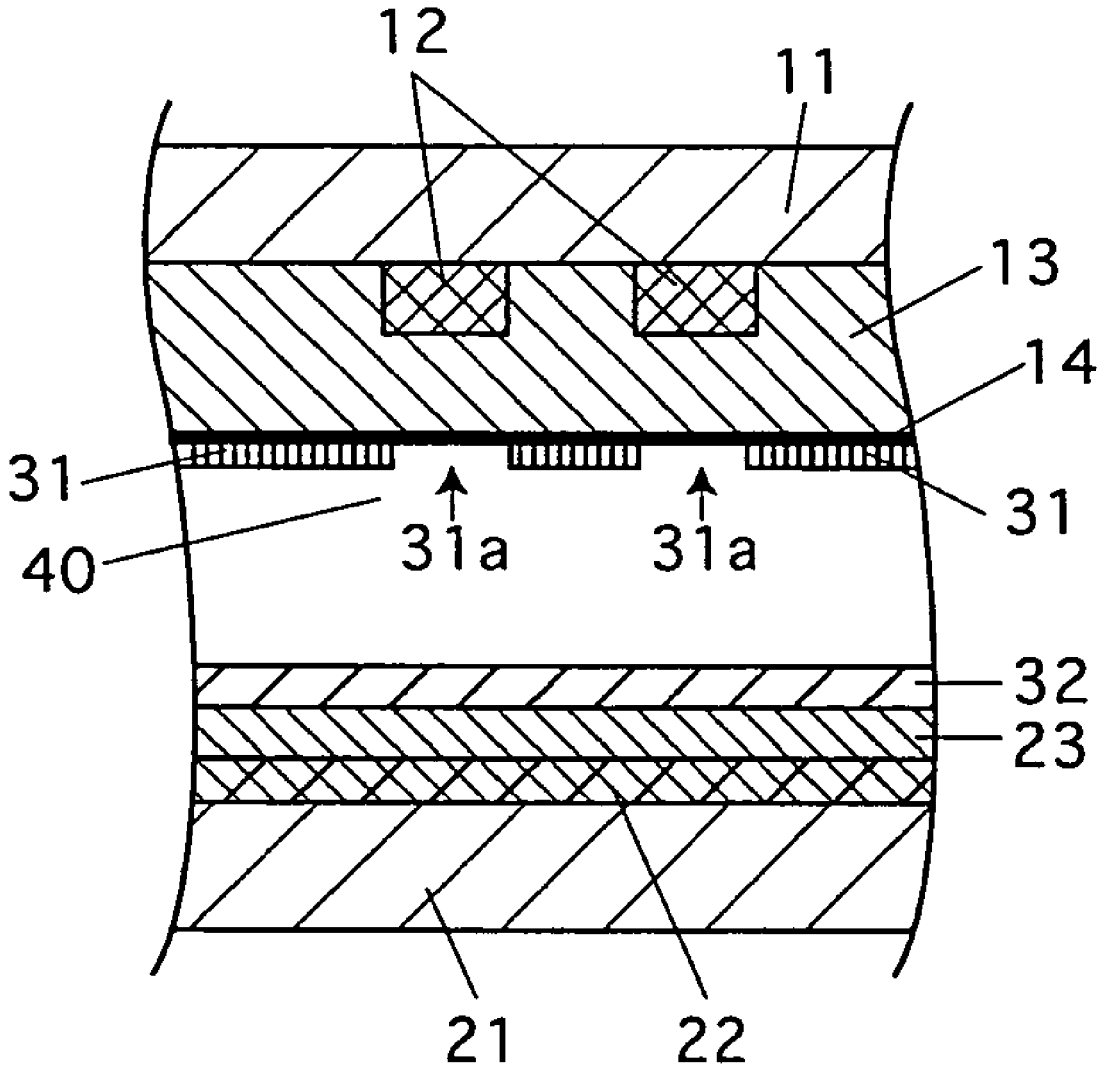
FIG. 2 is a cross-sectional view on arrow X taken at line X-X of FIG. 1.

Next, a shape of the phosphor film 31 is explained in accordance with FIG. 2. FIG. 2 is a cross-sectional view on arrow X taken at line X-X of FIG. 1.

As illustrated in FIG. 2, not all of the dielectric protecting film 14 between two adjacent barrier ribs 30 is covered by the phosphor film 31. The phosphor film 31 is cut out at parts thereof corresponding to the display electrodes 12 that is formed on the surface of the dielectric protecting film 14. The cut out parts (hereinafter referred to as cutouts 31*a*) are formed so that parts of the dielectric protecting film 14 corresponding to the display electrodes 12 are exposed to the discharge spaces 40 directly. By doing so, a property that the dielectric protecting film 14 has a high secondary electron emission coefficient is effectively utilized.

3. Connection between Panel and Driving Circuit

Figure 3:
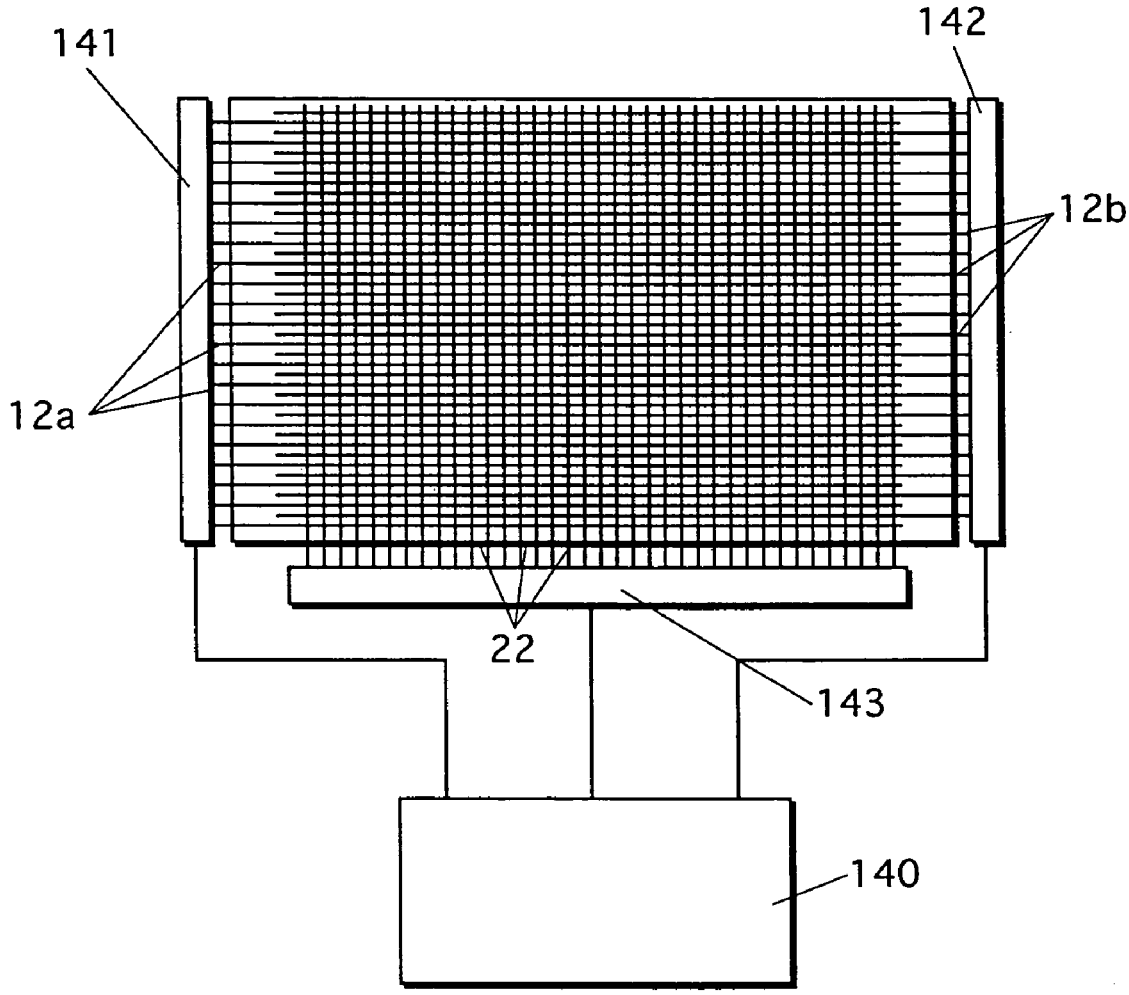
FIG. 3 is a structural view illustrating a plasma display device comprising the PDP of FIG. 1 and a driving circuit.

A connection between the AC type PDP 1 and a driving circuit is explained in accordance with FIG. 3.

As illustrated in FIG. 3, a scanning driver 141, a sustaining driver 142, a data driver 143, and a driving circuit 140 are connected to the AC type PDP 1.

A half of the display electrodes 12 formed on the AC type PDP 1 (hereinafter referred to as scanning electrodes 12*a*) are connected to the scanning driver 141, and the rest of the display electrodes 12 formed on the AC type PDP 1 (hereinafter referred to as sustaining electrodes 12*b*) are connected to the sustaining driver 142. Each of the scanning electrodes 12*a* and the sustaining electrodes 12*b* are alternately positioned in stripes.

Further, all of the address electrodes 22 are connected to the data driver 143.

The drivers 141, 142, and 143 are connected to the driving circuit 140. A plasma display device having the AC type PDP 1 is structured as described above.

According to the above plasma display device, address discharge is generated by applying a voltage between the scanning electrodes 12*a* and the address electrodes 22 at cells to emit light. After the address discharge, sustaining discharge is generated by applying a pulse voltage between the scanning electrodes 12*a* and the sustaining electrodes 12*b*. With the sustaining discharge, the discharge gas emits the ultraviolet rays, and the emitted ultraviolet rays are converted into visible light by the phosphor film 31 and the phosphor layer 32. In this way, the cells emit light, and images are displayed in the AC type PDP 1.

4. Manufacturing Method of AC Type PDP 1

Next, a manufacturing method of the AC type PDP 1 having the above construction is explained.

4-1. Manufacturing Method of Front Panel 10

The display electrodes 12 are formed in the following manner; a paste containing Ag is applied on the main surface of the front glass substrate 11 using the screen printing method, and then the paste is baked. The display electrodes 12 are formed in stripes parallel to each other.

The first dielectric layer 13 is formed in the following manner; a paste containing dielectric glass particles is applied to an entire surface of the main surface of the front glass substrate 11 so as to cover both the front glass substrate 11 and the display electrodes 12 that have been formed there the front glass substrate 11, using the screen printing method, and then the paste is baked. A thickness of the first dielectric layer 13 is about 20 μm.

The dielectric protecting film 14 is formed by covering the surface of the first dielectric layer 13 by a thin film of MgO using a method such as spattering.

The phosphor film 31 is the crystalline thin film comprising the thin crystals made of the phosphor material, and is formed by growing the thin film crystal, using the EB evaporation method. The forming method of the phosphor film 31 will be detailed later.

4-2. Manufacturing Method of Back Panel 20

A method of forming the address electrodes 22 and the second dielectric layer 23 in manufacturing the back panel 20 is basically the same with a case of the front panel 10 as described above.

The barrier ribs 30 are formed by applying a glass paste for barrier ribs on the second dielectric layer 23 using screen printing, and then baking the glass paste. In each of the grooves formed by the barrier ribs 30 and the second dielectric layer 23, a phosphor paste for each color having one of the above listed compositions is applied using screen printing and then baked to form the phosphor layers 32. The phosphor layers 32 are formed on the side walls of the barrier ribs 30, and on a bottom surface of the groove, e.g. an upper surface of the second dielectric layer 23.

4-3. Sealing of Front Panel 10 and Back Panel 20

The front panel 10 and the back panel 20 manufactured in the above-described method are sealed together in a following manner; a sealing glass (glass frit) is applied to the front panel 10 and the back panel 20 at parts where both panels are to be sealed, and sealing glass layers are formed by prebaking. After that, the front panel 10 and the back panel 20 are positioned so that the display electrodes 12 and the address electrodes 22 face each other orthogonally. Then, the panels 10 and 20 are heated up so that the sealing glass layers melt, and the front panel 10 and the back panel 20 are sealed together.

The discharge spaces 40 formed by the sealing is exhausted to a high vacuum status ($1.0\times10^{-4}$ Pa, for example), and the discharge gas is enclosed therein at a predetermined pressure. Finally, by sealing holes for enclosing the discharge gas, the AC type PDP 1 is completed.

4-4. Forming Method of Phosphor Film 31

Figure 4:
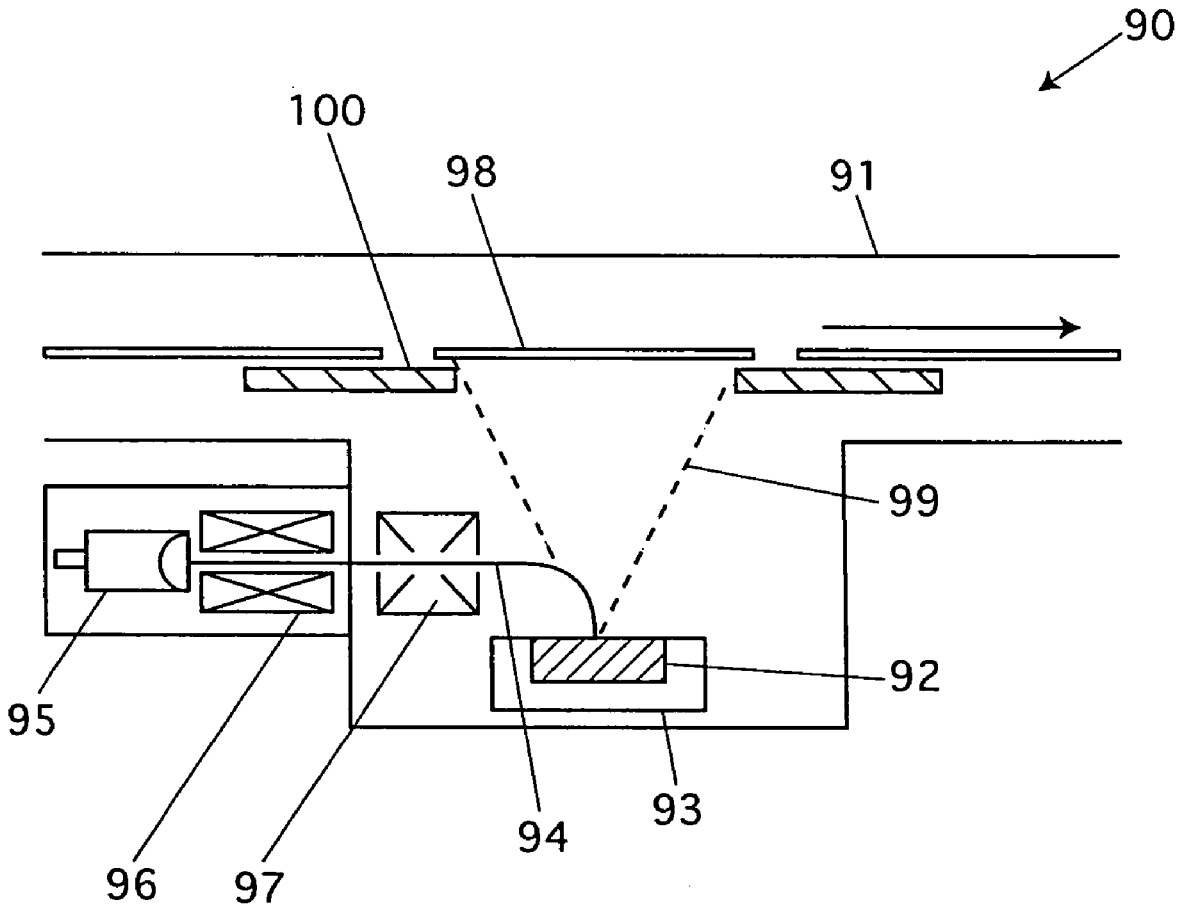
FIG. 4 is a structural view illustrating an apparatus for EB evaporation for forming a crystalline thin film.
Figure 5:
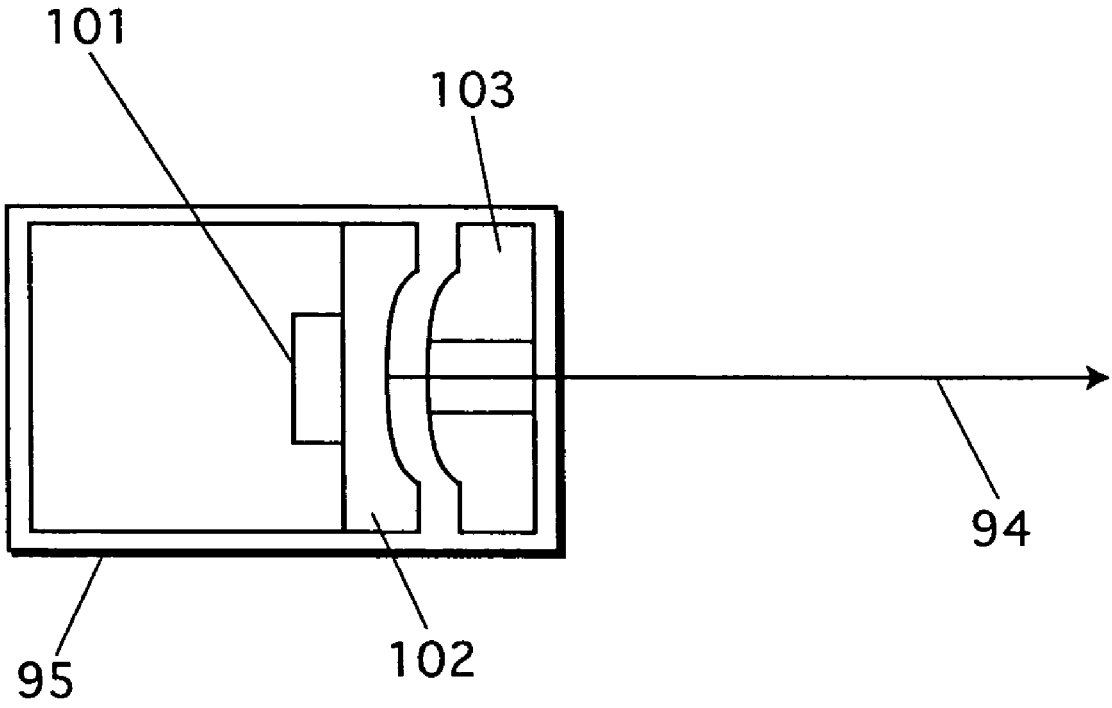
FIG. 5 is a structural view illustrating an electron gun of FIG. 4.

A forming method of the phosphor film 31, which is a characteristic part of the AC type PDP 1, is explained in accordance with FIGS. 4 and 5.

In forming the phosphor film 31, an EB evaporation apparatus as shown in FIG. 4 is used, unlike the forming method of the phosphor layer 32.

As shown in FIG. 4, an EB evaporation apparatus 90 includes a vacuum chamber 91 that can be evacuated. In the vacuum chamber 91, a hearth 93 for containing an evaporation material 92, an electron gun 95 for irradiating an electron beam 94, a convergence coil 96 for converging the irradiated electron beam, and a deflection coil 97 for deflecting the irradiated electron beam are provided.

Above the main components of the EB evaporation apparatus 90, a carrier path (not shown in the drawing) for carrying a glass substrate 98 on which the phosphor film 31 is to be formed is positioned so that the phosphor material is attached to a lower surface of the glass substrate 98 moving to an arrow direction in the drawing at a constant speed. Above the carrier path, a heater (not shown in the drawing) is positioned, and the glass substrate 98 is heated up by heat radiation from the heater.

The electron gun 95, which is one of the components of the EB evaporation apparatus 90, has such a structure that is illustrated in FIG. 5.

As shown in FIG. 5, the electron gun 95 includes a filament 101 as a heat source, a pair of electrodes including a cathode 102 and an anode 103. The electron beam 94 is radiated from the heated filament 101, accelerated by the cathode 102 and the anode 103, and then irradiated at the convergence coil 96.

In FIG. 4, a covering plate 100 is disposed in the EB evaporation apparatus 90 so as to prevent vapor 99 of the evaporation material 92 from adhering to units in the carrier path.

The phosphor film 31 is formed using the above EB evaporation apparatus 90 in a following manner.

First, the evaporation material 92 having the composition of the color to be formed is set in the hearth 93. The evaporation material is made into a pellet form in advance.

Next, the electron beam 94 is irradiated to the hearth 93 and the evaporation material 92 is heated to about 2000° C. so that the evaporation material 92 evaporates. The vapor 99 from the hearth 93 goes upward and adheres to an exposed surface of the glass substrate 98 in the carrier path. A mask is formed in advance at parts of the glass substrate 98 where the phosphor film 31 is not to be formed.

Intensity of the electron beam 94 to radiate and carrying speed of the glass substrate 98 are set such that a growth rate of the phosphor film 31 becomes about 2.0 (nm/s). The intensity of the electron beam 94 is determined by a current value in a state that a voltage value between the cathode 102 and the anode 103 is kept constant.

Although the EB evaporation is employed in the forming of the phosphor film 31 in the above explanation, a vapor phase growth method may also be employed such as a vacuum evaporation method, a spattering method, or a CVD method. Note that, in forming the phosphor film 31 on the dielectric protecting film 14, it is preferable that the phosphor film is formed without exposing the front panel 10 to the air after the dielectric protecting film 14 has been formed. Further, by forming the dielectric protecting film 14 and the phosphor film 31 while the temperature of the glass substrate is maintained, it is possible to form the phosphor film 31 having desirable crystallinity.

Moreover, it is desirable that an atmosphere is optimized for each material when forming the phosphor film 31. For example, when forming the phosphor film using a material such as $SnO_2$:Eu, it is necessary that the atmosphere contains oxygen in order to suppress generation of oxygen defects. When using a material such as ZnO:Zn, it is desirable that the atmosphere is reducing.

In addition, it is desirable that the atmosphere is in a reduced pressure not containing oxygen nor reducing, when using a material such as ZnS:Ag.

The impact excitation type phosphor material is used for forming the phosphor film 31 in the above explanation, because, in comparison with a conventional ultraviolet excitation type phosphor material, a property of the impact excitation type phosphor material, such that light emission is caused by energy of an impact generated when electrons and ions collide, is more appropriate when the phosphor film 31 is formed on the top surface of the front panel 10 in vicinity of discharge areas. Note that the ultraviolet excitation type phosphor material may also be used in forming the phosphor film 31.

4-5. Substrate Temperature and Crystallinity of Phosphor Film

Figure 6:
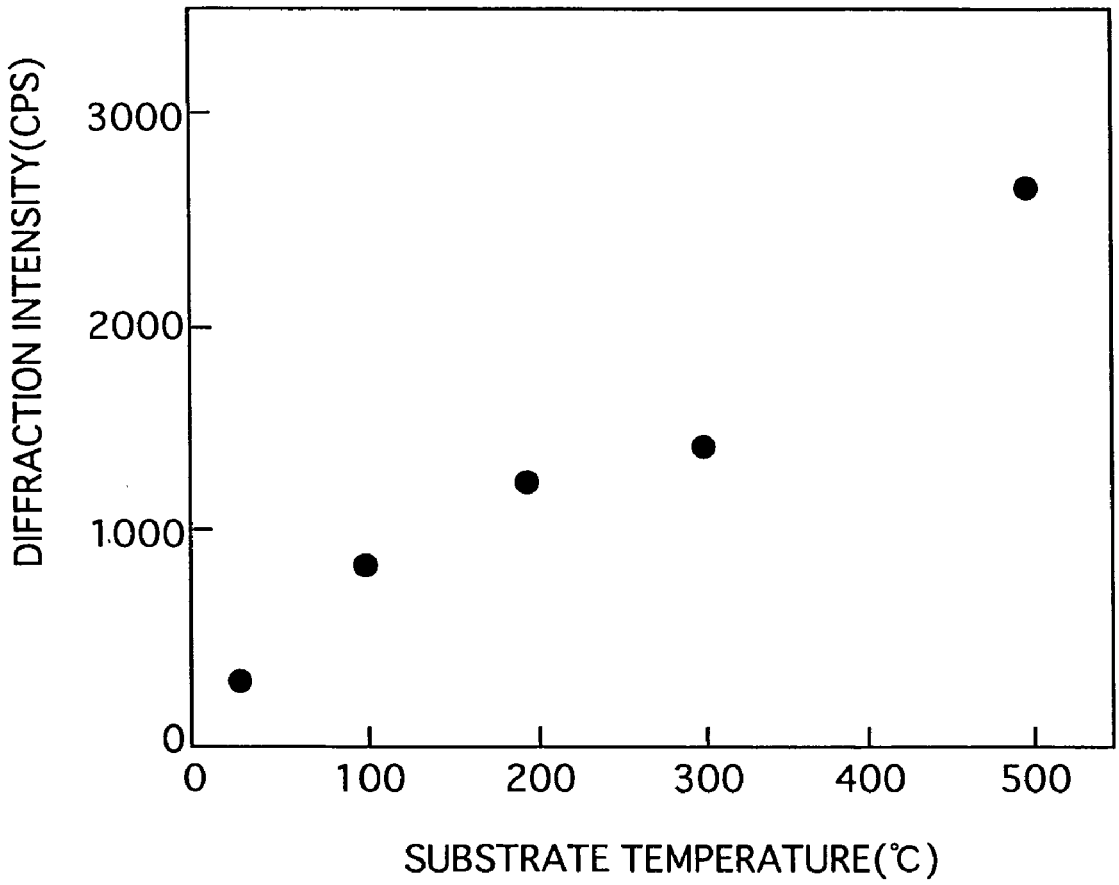
FIG. 6 is a graph illustrating a relation between substrate temperature and diffraction intensity based on X-ray diffraction.

The reason for heating up the glass substrate when forming the phosphor film 31 is explained below, according to FIG. 6. FIG. 6 is a graph showing a relation between (a) a temperature of the glass substrate when forming the phosphor film 31 and (b) X-ray diffraction peak intensity of (111) orientation.

As illustrated in FIG. 6, the diffraction intensity goes up as the substrate temperature rises. This tendency indicates that the higher the substrate temperature becomes, the higher the crystallinity of the phosphor film becomes. Thus, in order to form the phosphor film having the high crystallinity, it is desirable that the glass substrate is heated up to an extent that the high temperature does not give adverse effects to the glass substrate and other components formed thereon.

5. Consideration About Phosphor Film 31

Figure 7:
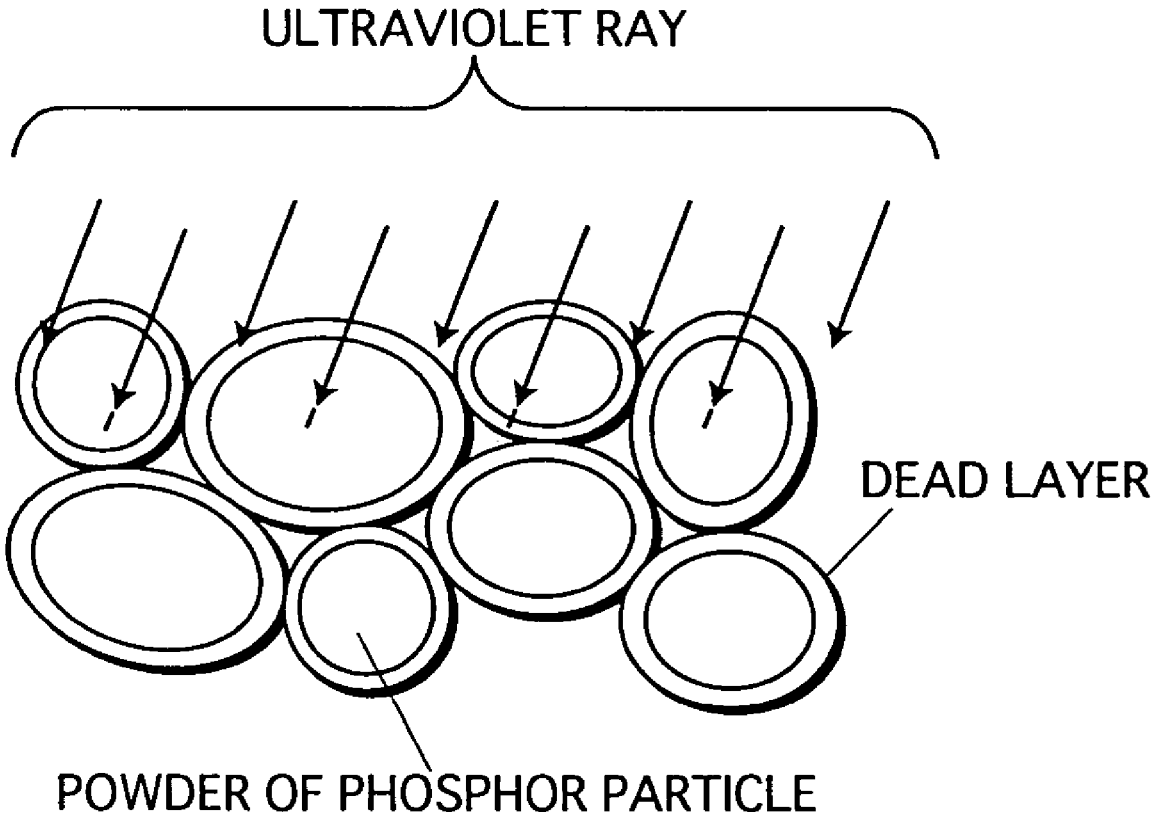
FIG. 7 is a schematic diagram illustrating an incident path of the ultraviolet rays to a phosphor layer made of phosphor particles.
Figure 8:
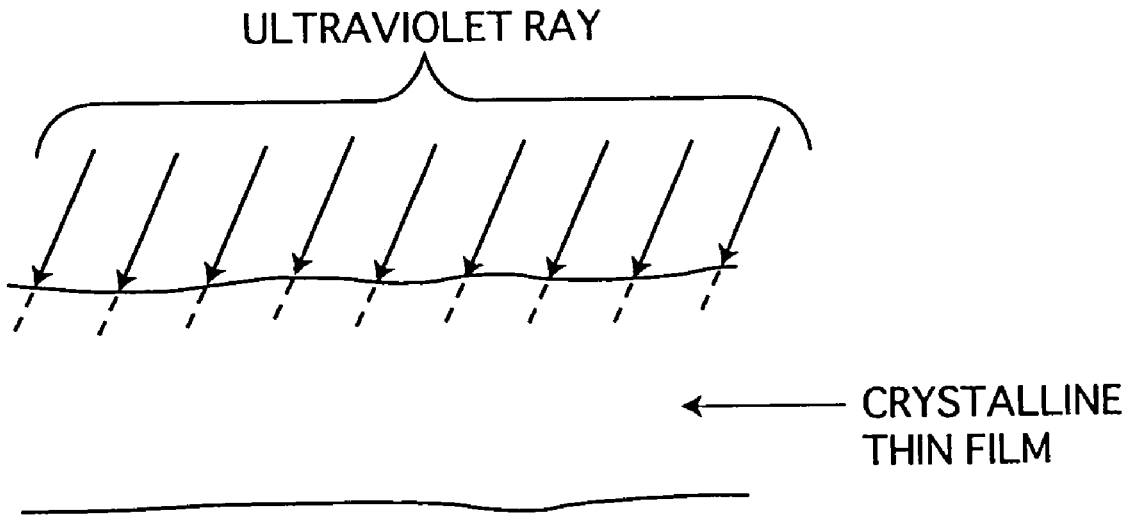
FIG. 8 is a schematic diagram illustrating an incident path of the ultraviolet rays to the crystalline thin film comprising a thinned crystal made of a phosphor material.

5.1 Advantage of Crystalline Thin Film Comprising Thinned Crystal Made of Phosphor Material The phosphor film 31 explained above is the crystalline thin film comprising the thinned crystal made of the phosphor material, and accordingly, has excellent visible light penetration efficiency, and the converging efficiency from the ultraviolet rays to the visible light is also high. In the following section, an advantage of the phosphor film 31 is explained according to FIGS. 7 and 8. FIG. 7 is a diagram illustrating an incident path of the ultraviolet rays to a surface of the phosphor layer made of phosphor particles formed using the thick film forming method. FIG. 8 is a diagram illustrating an incident path of the ultraviolet rays to a surface of the crystalline thin film, comprising the thinned crystal made of the phosphor material, formed using the vacuum evaporation film forming process.

As illustrated in FIG. 7, when the phosphor layer is formed using the thick film forming method, a dead layer is formed on top surfaces of the phosphor particles. Energy propagation ratio through the dead layer toward a center of the is low, even when the ultraviolet rays are absorbed. Accordingly, the converging efficiency from the ultraviolet rays into the visible light becomes low. Especially, if the ultraviolet rays incident to the thick dead layer, little contribution to the light emission is made.

On the other hand, as illustrated in FIG. 8, in a case of the phosphor film 31, which is the crystalline thin film comprising the thinned crystal made of the phosphor material, a dead layer is not likely to be formed on a top surface of the phosphor film, even though a dead layer could be formed in an early stage of crystal growth. Accordingly, the phosphor film 31 has higher converging efficiency to the visible light in comparison with the phosphor layer 32 made of the phosphor particles.

Further, because the crystalline thin film comprising the thinned crystal is a single solid solution and does not scatter easily, the visible light penetration efficiency becomes very high.

5-2. Consideration About Thickness of Phosphor Film 31

Figure 9:
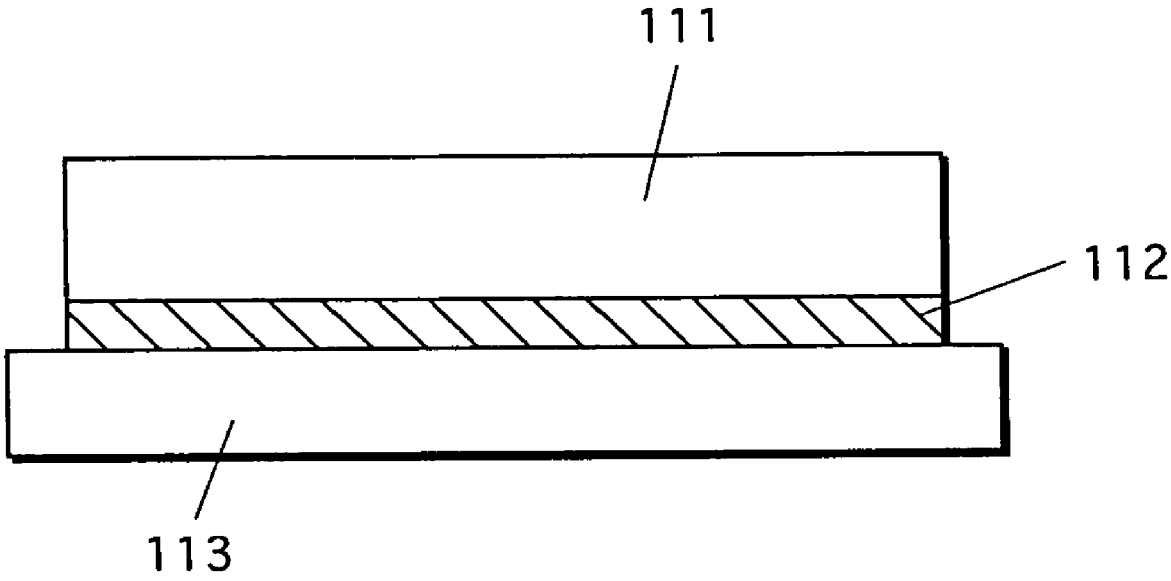
FIG. 9 is a schematic view illustrating a sample for evaluation of phosphors.
Figure 10:
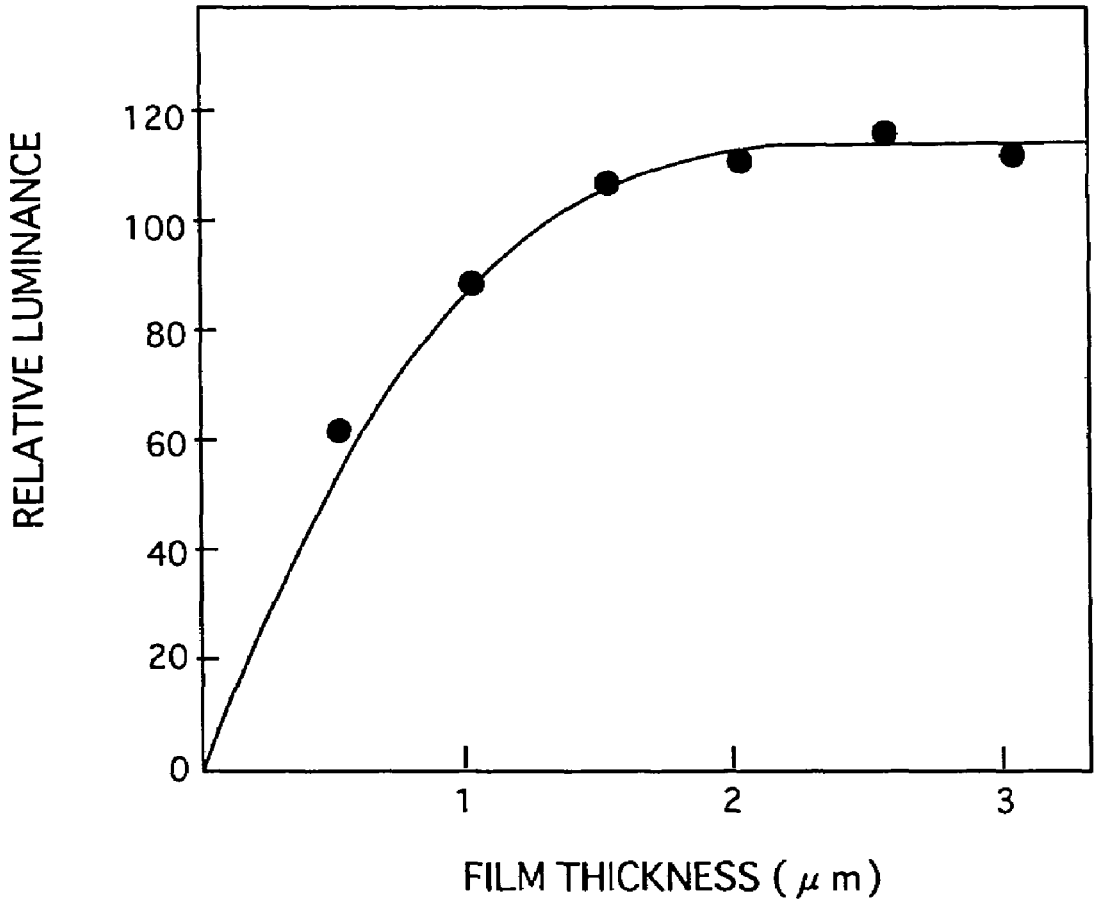
FIG. 10 is a graph illustrating a relation between thickness of the crystalline thin film comprising the thinned crystal made of the phosphor material, and luminance.

Next, how to set the thickness of the phosphor film 31 is explained with accordance with FIGS. 9 and 10. FIG. 9 illustrates a sample for evaluation in order to investigate a relation between luminance and the thickness of the phosphor film 31. FIG. 10 is a graph illustrating a result of measurement of the luminance when the sample is irradiated with a 147 nm excimer lamp. Relative luminance in the graph indicates the luminance of the phosphor film given that the luminance of the conventional phosphor layer made of phosphor particles is 100.

As illustrated in FIG. 9, the sample used here is such that a visible light reflection layer 112 is formed on a surface of a glass substrate 113, and a phosphor film 111 is formed over the visible light reflection layer 112. The phosphor film 111 is a crystalline thin film.

As illustrated in FIG. 10, the relative luminance of the phosphor film 111 goes up in proportion to thickness increase till 2 μm. Above 2 μm in thickness, the relative luminance of the phosphor film 111 becomes saturated around 120 in the luminance. This result indicates that the luminance of the phosphor film 111 is higher than the phosphor layer made of phosphor particles by 20%.

Accordingly, it is best to set the film thickness of the phosphor film 111 around 2 μm. By doing so, both the visible light penetration efficiency and the sufficient luminance when the ultraviolet rays are irradiated to the phosphor film 31 are ensured. When a blue phosphor film comprising the thinned crystal is formed by the phosphor material with the above composition, for example, the visible light penetration efficiency becomes as high as 97% when the film thickness is 2 μm.

5-3. Mechanism of Improving Luminous Efficiency in AC Type PDP 1

Next, a mechanism of improving the luminous efficiency in the AC type PDP 1 is explained below in accordance with FIG. 11.

In the AC type PDP, the ultraviolet rays emitted from the discharge gas travel in all directions in each of the discharge spaces 40. In FIG. 11, for convenience of explanation, an arrow U1 indicates an ultraviolet ray toward the phosphor film 31, and an arrow U2 indicates an ultraviolet ray toward the phosphor layer 32.

Figure 11:
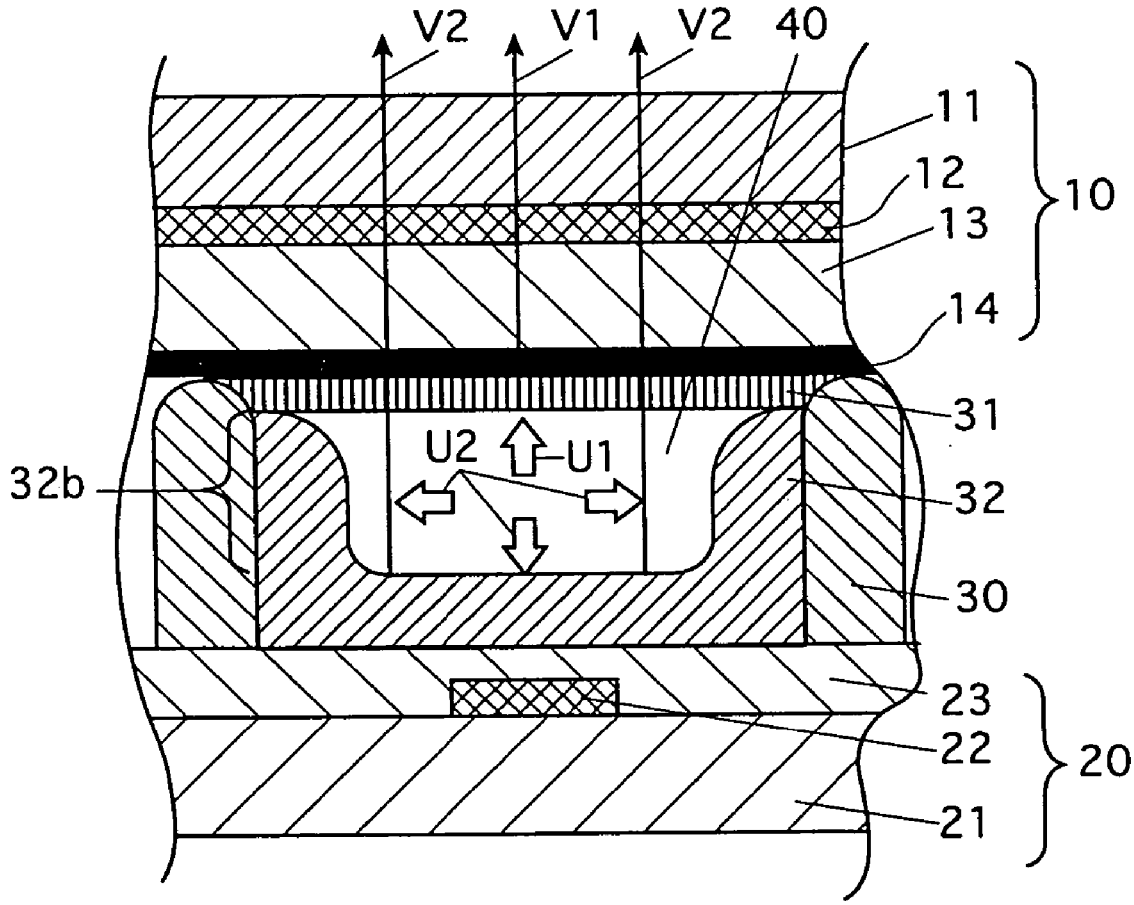
FIG. 11 is a cross-sectional view on arrow Y taken at line Y-Y of FIG. 1.

In FIG. 11, an arrow V1 is the visible light converged by the phosphor film 31 from the ultraviolet ray indicated by the arrow U1. The arrow V1 indicates the visible light that passes through the front panel 10. An arrow V2 indicates the visible light converged by the phosphor layer 32 from the ultraviolet ray of the arrow U2, and also passes through the front panel 10. The visible light indicated by the arrows V1 and V2 contribute to the actual luminous efficiency of the AC type PDP 1.

In a case of the conventional AC type PDP, the ultraviolet ray indicated by the arrow U1 is absorbed in the front panel without being converged into visible light, because the conventional AC type PDP does not include the phosphor film 31.

On the other hand, in a case of the AC type PDP 1, however, the ultraviolet ray, indicated by the arrow U1, is converged into the visible light, indicated by the arrow V1, by the phosphor film 31, and emitted outside the panel.

Moreover, because the phosphor film 31 has the high visible light penetration efficiency, the ultraviolet ray indicated by the arrow U2 can be emitted outside the panel as the visible light indicated by the arrow V2 without wasting, and thus achieves a high luminous efficiency.

As has been described above, the AC type PDP 1 enables to converge the ultraviolet rays generated by the discharge into the visible light with high efficiency, and to efficiently emit the visible light outside the panel. Therefore, the luminous efficiency of the AC type PDP 1 is higher than the luminous efficiency of the conventional AC type PDP.

5-4. Blue Phosphor Material as Example

Figure 12:
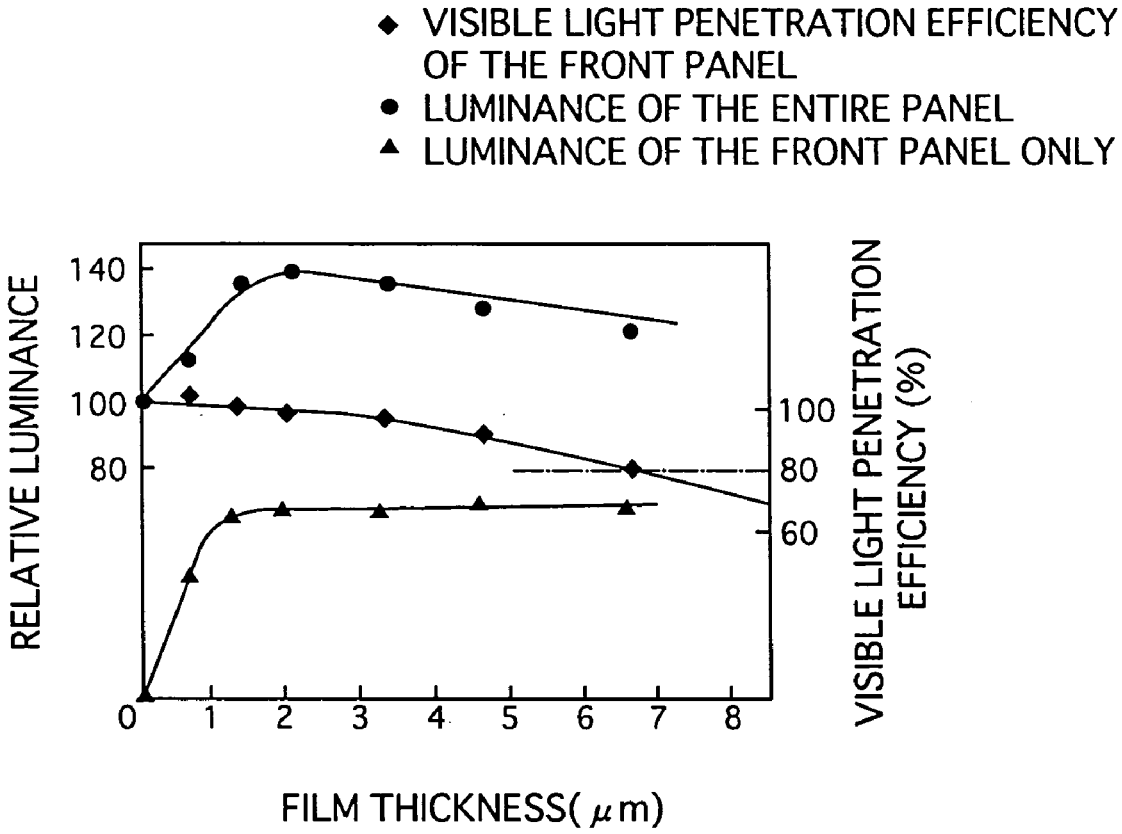
FIG. 12 is a graph illustrating a relation between film thickness and relative luminance.

A specific example is explained in accordance with FIG. 12, in order to show that the AC type PDP 1 is advantageous to the conventional AC type PDP in terms of the luminous efficiency. FIG. 12 is a graph illustrating a relation between film the thickness of the phosphor film 31 and the relative luminance of the panel, taking a blue phosphor film as an example. The relative luminance in this drawing indicates relative values when the luminance of the conventional AC type PDP is 100. The conventional AC type PDP includes the phosphor layers made of phosphor particles only on the back panel.

As shown in FIG. 12, the visible light penetration efficiency of the front panel (the phosphor film) decreases as the film thickness increases. For example, while the visible light penetration efficiency is about 97% when the film thickness is 2 μm, the visible light penetration efficiency is about 85% when the film thickness is 6 μm.

The relative luminance of the panel as a whole, which is derived from the visible light penetration efficiency and the relative luminance of the phosphor film, is indicated by black round marks in the drawing. As shown in FIG. 12, the relative luminance of the panel as a whole reaches the peak when the film thickness is 2 μm, and gradually decreases as the film becomes thicker. The relative luminance when the film thickness is 2 μm is calculated as follows.

In a case of the AC type PDP 1 comprising the font panel having the phosphor film 31, visible light emission efficiency is 97%×70%+30%=97.9%, given that the visible light penetration efficiency of the front panel is 97% and U1/(U1+U2) is 30%.

The visible light emission efficiency is a proportion of the visible light actually emitted outside through the front panel out of the visible light converged from the ultraviolet rays.

On the other hand, in a case the conventional AC type PDP that does not include the front panel having the phosphor film, the visible light emission efficiency becomes 100%×70%=70%, given that the visible light penetration efficiency of the front panel is 100% and U2 is 70%.

Therefore, the visible light emission efficiency and the luminous efficiency of the AC type PDP 1 that includes the font panel 10 having the phosphor film 31 with 2 μm in thickness is higher than the visible light emission efficiency and the luminous efficiency of the conventional AC type PDP by 40%, respectively.

6. Modified Example of First Embodiment

In the explanation of the AC type PDP 1, the front panel 10 includes the phosphor film 31 at an area corresponding to all of the red, green, or blue cells. However, the area does not necessarily correspond to all the cells. For example, the area where the phosphor film 31 is formed can be limited to a part of the front panel 10 corresponding to the cells of a specific color to improve the luminance of the color, and accordingly, it is possible to make color temperature high when white light is displayed in an entire screen.

For example, a part of the front panel where the phosphor film 31 is formed can be limited to the part corresponding to blue cells, which is generally formed by a phosphor material having low visible light convergence efficiency. Although not shown in the drawing, the inventors of the present invention confirmed that the color temperature was 10000 K, when white color was displayed in an entire screen of the AC type PDP by setting the cells having each color to emit light under the same condition. The color temperature of the conventional AC type PDP was 6000 K, when the same test was carried out under the same condition. The color temperature of 10000 K is close to 11000 K, which is the best temperature for a panel property, and it is possible to suppress luminance decrease caused when adjusting the color temperature.

Note that, when forming the phosphor film 31, it is important to determine the color temperature considering both the composition and properties of the phosphor material used for the phosphor film of each color, so that an appropriate color temperature is obtained in terms of the luminance of the panel and as a whole.

The above explanation was given to the forming method of the crystalline thin film comprising the thinned crystal made of the phosphor material, and the advantage of the PDP having the crystalline thin film, taking the AC type PDP as an example. However, the present embodiment can also be applied to a DC type PDP.

Second Embodiment

Figure 13:
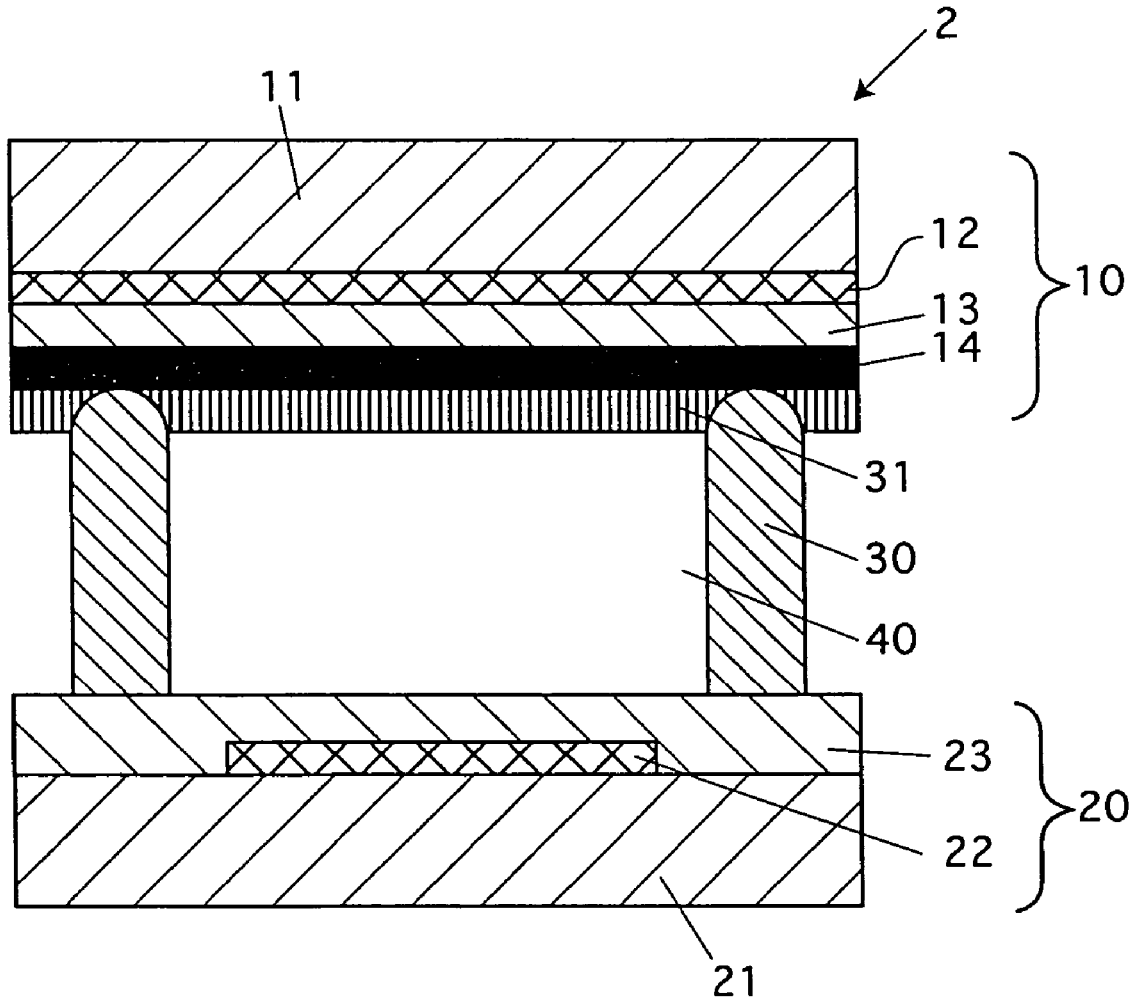
FIG. 13 is a cross-sectional view illustrating a part of an AC type PDP according to a Second Embodiment.
Figure 14:
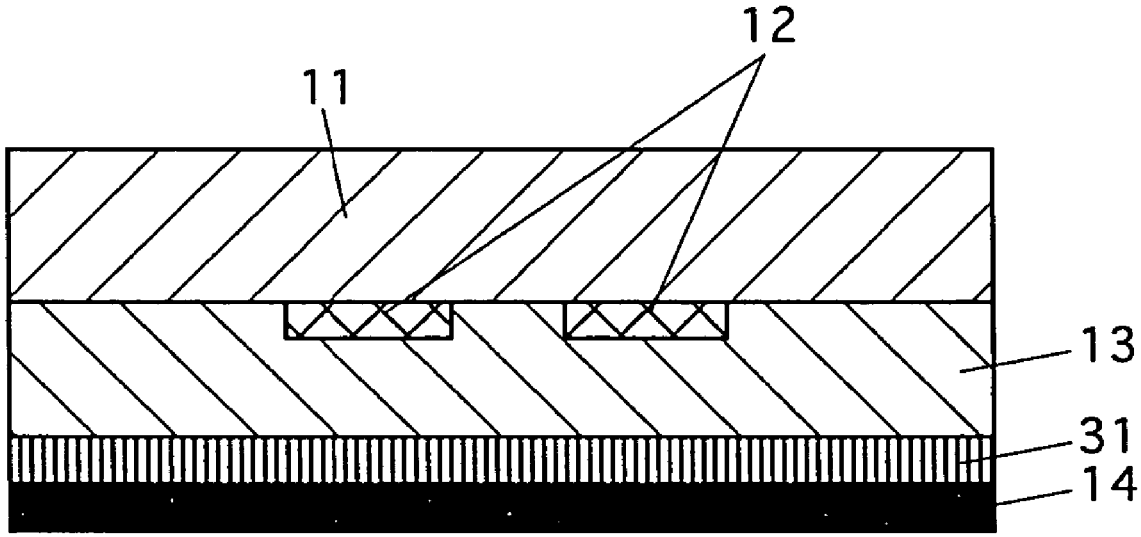
FIG. 14 is a cross-sectional view illustrating a front panel such that the crystalline thin film is inserted between a dielectric layer and a dielectric protecting film.

An AC type PDP 2 according to a Second Embodiment is explained below in accordance with FIG. 13. FIG. 13 is a cross-sectional view illustrating a part of the panel corresponding to one light emitting cell of the AC type PDP 2.

As shown in FIG. 13, only the phosphor film 31 is formed on the surface of the front panel 10. In other words, a phosphor layer is not formed on the back panel 20 and the barrier ribs 30.

Other than the above noted part, the AC type PDP 2 has the same construction as the AC type PDP 1, and is formed using the same manufacturing method.

Although not shown in the drawing, the AC type PDP 2 is also the same as the AC type PDP 1 in that the phosphor film 31 has the cutouts 31*a*.

The AC type PDP 2 can achieve a sufficiently high luminance without forming the phosphor layer made of conventional phosphor particles on the back panel 20 or the barrier ribs 30, because, as has been described above, the luminous efficiency of the phosphor film, which is the crystalline thin film comprising a thinned crystal made of the phosphor material, is higher than the crystalline thin film of the phosphor layer made of the phosphor particles.

Further, the AC type PDP 2 has an advantage in production cost, because it is possible to manufacture the panel without applying and baking a phosphor material on the back panel 20 after disposing the barrier ribs 30.

In the First and Second Embodiments described above, the phosphor film 31 is formed on the top surface of the front panel 10, in other words, on the surface of the dielectric protecting film 14 facing the discharge spaces 40. However, the phosphor film 31 may also be formed between the first dielectric layer 13 and the dielectric protecting film 14.

In this way, the dielectric protecting film 14, which has an excellent secondary electron emission property, is exposed to the discharge spaces 40, and accordingly, the discharging is not prevented even if the phosphor film 31 does not include the cutouts 31*a* at corresponding parts to the display electrodes 12.

Therefore, it becomes unnecessary that the cutouts 31*a* are formed on the phosphor film 31, and a surface area of the phosphor film 31 increases at the same time. Accordingly, the AC type PDP obtains much higher luminance.

While anything is not formed on the second dielectric layer 23 on the back panel 20 in the above explained AC type PDP 2, a function for reflecting the visible light may be provided to the back panel 20, by forming a visible light reflecting layer on the second dielectric layer 23 that reflects the visible light to the front panel 10, or mixing $TiO_2$ in the second dielectric layer 23, for example. By doing so, it is possible to improve the luminance of the panel because the light emitted from the front panel 10 can be reflected to the front panel side without being emitted to the back panel 20 and wasted. Visible light reflection efficiency (the proportion of the visible light reflected to the visible light that incidents to the back panel) of the back panel 20, on which the visible light reflecting layer is formed, is 85% and above.

Third Embodiment

Figure 15:
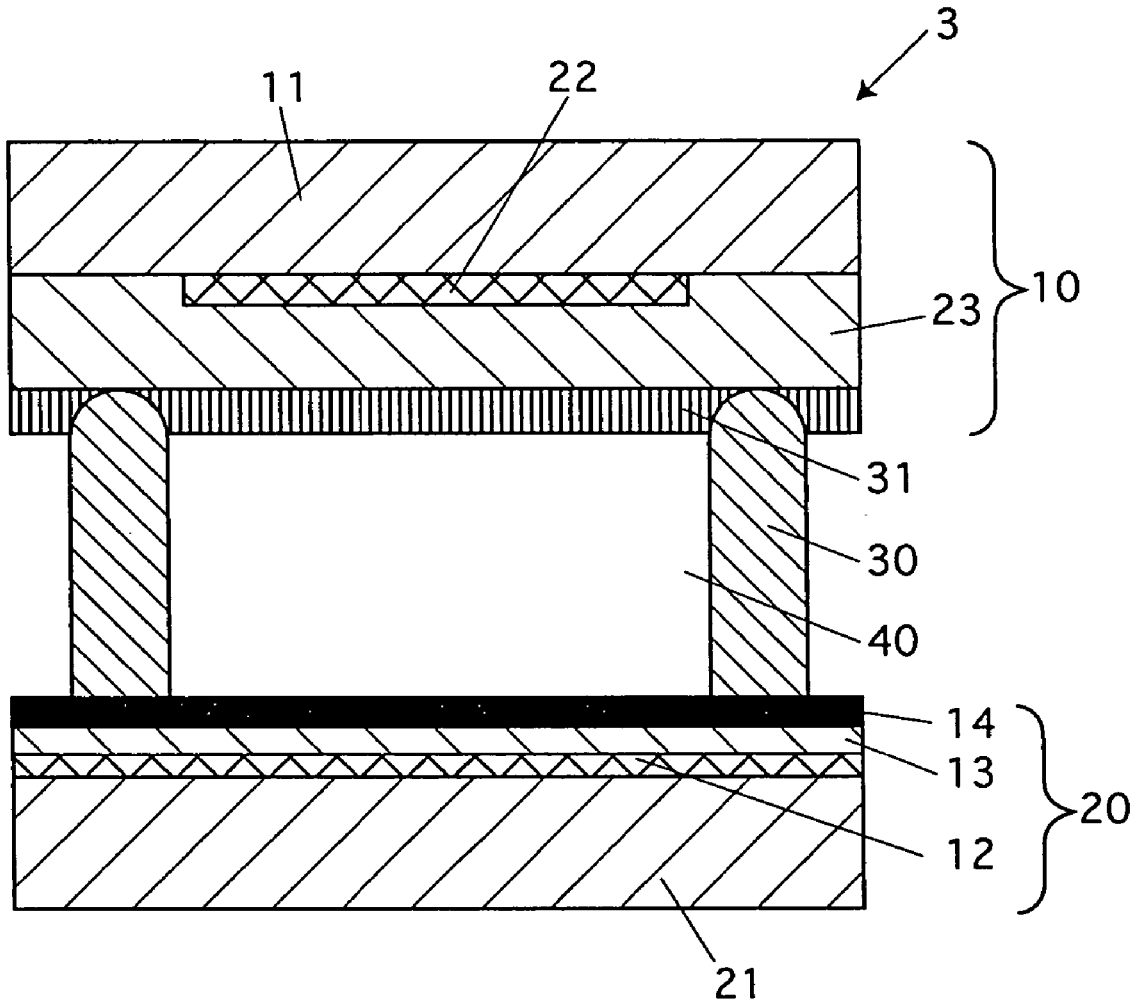
FIG. 15 is a cross-sectional view illustrating a part of an AC type PDP according to a Third Embodiment.
Figure 16:
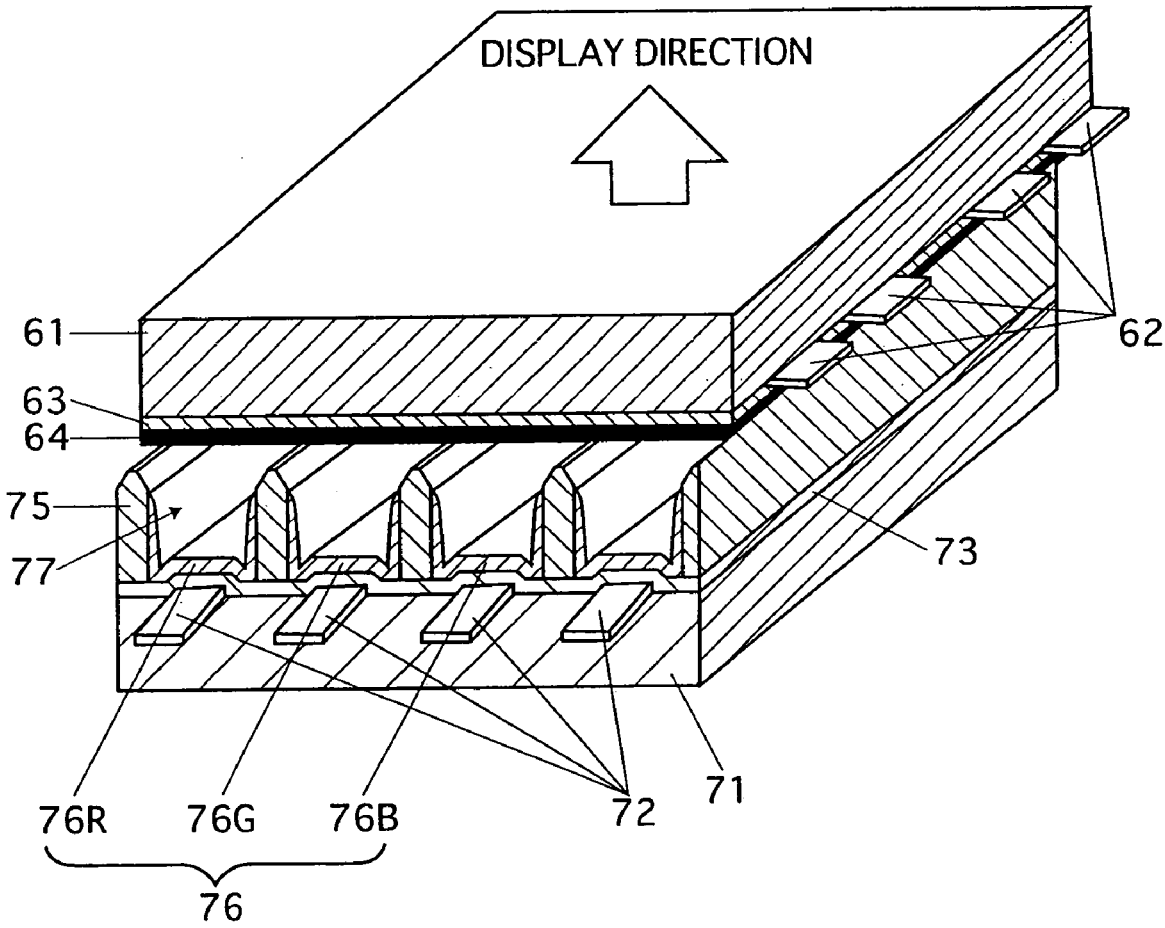
FIG.16 PRIOR ART
FIG. 16 is a partially sectioned perspective view, illustrating a conventional AC type PDP.

An AC type PDP 3 according to a Third Embodiment is explained in accordance with FIG. 15.

As shown in FIG. 15, the AC type PDP 3 is the same as the AC type PDP 2 in that the phosphor film 31 is formed only on the front panel 10, but different from the AC type PDP 2 in that the address electrodes 22 and the second dielectric layer 23 are formed on the front panel 10, and the display electrodes 12, the first dielectric layer 13, and the dielectric protecting film 14 are formed on the back panel 20.

In employing such a structure, the address electrodes 22 and the second dielectric layer 23 are formed by material having the high visible light penetration efficiency so that the penetration of the visible light is not interfered. Specifically, transparent electrodes such as Indium Tin Oxide (ITO) and $SnO_2$ are used for the address electrodes 22, and lead glass containing lead oxide as a main component is used for the second dielectric layer 23. The address electrodes 22 are formed along a shorter side, and only small amount of current flows in comparison with the display electrodes 12. In this way, even when electrical resistance is large, potential drop at electrodes' edges, which are not on the side connected to the data driver 143, becomes small. Therefore, the address discharge is not affected even when the address electrodes 22 are formed only by ITP.

Further, the phosphor film 31 formed on the second dielectric layer 23 does not include the cutouts 31*a*, because the display electrodes 12 are not formed on the front panel 10. In other words, the phosphor film 31 is formed on an entire area where the visible light passes through.

Conventionally, in order to make the electrical resistance small, the display electrodes 12 formed on the front panel 10 include bus electrodes made of a metal material formed on the transparent electrodes. Accordingly, a part of the visible light emitted in the light emitting cells is blocked by the bus electrodes.

On the other hand, in the AC type PDP 3, the display electrodes 12 are formed on the back panel 20, and the visible light emitted outside through the front panel is not blocked by the display electrodes 12. Therefore, the AC type PDP 3 is advantageous in improving both the luminance and the luminous efficiency.

Moreover, in the AC type PDP 3, the display electrodes 12 and the dielectric protecting film 14 are formed on the other glass substrate from the glass substrate on which the phosphor film 31 is formed. Accordingly, a large surface area can be achieved because a cutout does not need to be included in the phosphor film 31, and the discharge property is not sacrificed. In addition, the luminance is maintained high because the dielectric protecting film 14 is formed so as to be directly exposed to the discharge spaces 40. In a case of 42-inch NTSC panels, for example, the display electrodes account for nearly 70% of an entire cell area. By employing the structure of the AC type PDP 3 to the above NTSC panel, it is possible to obtain three times higher light emission luminance than employing the structure of the AC type PDP 1 or the AC type PDP 2, which includes the display electrodes in the front panels, because the AC type PDP 3 does not include the cutout.

Further, in comparison with the AC type PDP 1 or the AC type PDP 2 when the phosphor film 31 is formed between the dielectric layer 13 and the dielectric protecting film 14 and does not have the cutouts 31*a*, the AC type PDP 3 according to the present embodiment is still advantageous because the AC type PDP 3 does not include the metal electrodes that prevent the visible light from passing through the front panel 10.

Therefore, by using the AC type PDP 3, it is possible to improve the luminous efficiency of an entire panel, and to obtain the high light emission luminance.

In the Second Embodiment and the Third Embodiment explained above, neither of the phosphor film 31 nor the phosphor layer 32 is formed on the surface of the back panel 20 or the side walls of the barrier ribs 30. However, forming either the phosphor film 31 or the phosphor layer 32 on the surface of the back panel 20 or the side walls of the barrier ribs 30 is also effective in order to further improve the light emission luminance of the panel. Note that, when the phosphor film 31 or the phosphor layer 32 is formed on the back panel 20 of the PDP in the Third Embodiment, it is desirable that the phosphor film 31 or the phosphor layer 32 includes the cutouts 31*a*.

Fourth Embodiment

An AC type PDP 4 according to a Fourth Embodiment is explained below.

The AC type PDP 4 has a similar construction with the conventional AC type PDP. Therefore, only a difference between the AC type PDP 4 and the conventional AC type PDP is explained without referring to drawings.

The AC type PDP 4 is different from the conventional AC type PDP in that the crystalline thin film comprising thinned crystal made of a phosphor material is formed on the back panel, while the phosphor layer of phosphor particles is formed in a case of the conventional AC type PDP.

The luminous efficiency of the panel of the AC type PDP 4 of the above structure is more advantageous, because the area on which the phosphor film having high luminous efficiency is larger than the AC type PDP 2 or the AC type PDP 3.

Further, forming the concave and the convex between the visible light reflection layer and the phosphor film 31 is effective because it is possible to make the effective surface area of the phosphor film 31 larger.

Note that the visible light reflection layer here is the same as the visible light reflection layer described in the Second Embodiment.

As has been described in the above, with the AC type PDP 4 having the function of reflecting the visible light, it is possible to improve the luminance of the panel because the light emission from the front panel 10 can be reflected to a side of the front panel 10 without being wasted by radiating to a side of the back panel 20. The visible light reflection efficiency (the proportion of the visible light reflected to the visible light that incidents to the back panel) of the back panel 20, on which the visible light reflecting layer is formed, is 85% and above.

Forming the concave and the convex in a way such as the staircase pattern or as the plurality of protrusions enables the smooth surface area larger.

In addition, by combining the back panel 20 of the AC type PDP 4 and the front panel 10 of the AC type PDP 1, an AC type PDP obtains further improved luminance and shows an excellent panel property.

An area where the display electrodes 12 are to be formed is not restricted to the front panel 10. The display electrodes 12 may be formed on the back panel 20 as in the Third Embodiment.

Although the explanations are given taking the AC type PDPs as examples in the above First to Fourth Embodiments, the same effect can be obtained when any of the above structures is applied to a DC type PDP.

INDUSTRIAL APPLICABILITY

Plasma Display Panels and manufacturing methods thereof according to the present invention are effective to achieve display devices for computers and television sets, especially, the display devices having high resolution and luminance.

The invention claimed is:

1. A plasma display panel comprising a front panel and a back panel facing each other, the plasma display panel having a plurality of light emitting cells in a space between the front panel and the back panel, wherein the front panel includes:

a front substrate;

a plurality of electrodes that are disposed on the front substrate;

a dielectric layer that covers the electrodes and the front substrate; and a protecting film that is disposed on the dielectric layer, and a crystalline thin film is disposed in an area that corresponds to at least a part of the light emitting cells, and is either on the protecting film or between the dielectric layer and the protecting film, the crystalline thin film comprising a thinned crystal made of a phosphor material.

2. A plasma display panel according to claim 1, wherein a thickness of the crystalline thin film is such that visible light penetration efficiency thereof is at least 85%.

3. A plasma display panel according to claim 2, wherein the plurality of light emitting cells include a red light emitting cell group, a green light emitting cell group, and a blue light emitting cell group, one or two areas each having the crystalline thin film are included in the front panel, the areas corresponding to one or two of the light emitting cell groups, respectively.

4. A plasma display device comprising:

the plasma display panel according to claim 3; and a driving circuit for driving the plasma display panel.

5. A plasma display panel according to claim 3, wherein two areas each having the crystalline thin film are included in the front panel, the areas corresponding to the green and blue light emitting cell groups, respectively.

6. A plasma display device comprising:

the plasma display panel according to claim 5; and a driving circuit for driving the plasma display panel.

7. A plasma display panel according to claim 1, wherein one area having the crystalline thin film is included in the front panel, the area corresponding to the blue light emitting cell group.

8. A plasma display device comprising:

the plasma display panel according to claim 7; and a driving circuit for driving the plasma display panel.

9. A plasma display panel according to claim 1, wherein the crystalline thin film is disposed on the protecting film, the crystalline thin film having cutouts at parts corresponding to the electrodes.

10. A plasma display device comprising:

the plasma display panel according to claim 9; and a driving circuit for driving the plasma display panel.

11. A plasma display panel according to claim 1, wherein phosphor layers made of phosphor particles are disposed on the back panel and/or surfaces of barrier ribs at parts corresponding to the light emitting cells, the barrier ribs being disposed on the back panel.

12. A plasma display panel according to claim 11, wherein the thinned crystal is made of a phosphor material having a different composition from a phosphor material that is used for the phosphor layers.

13. A plasma display panel according to claim 12, wherein the thinned crystal is made of an impact excitation type phosphor material.

14. A plasma display device comprising:

the plasma display panel according to claim 13; and a driving circuit for driving the plasma display panel.

15. A plasma display panel according to claim 1, wherein the back panel includes:

a back substrate;

a plurality of electrodes that are disposed on the back substrate; and a dielectric layer that is disposed over the electrodes and the back substrate, the dielectric layer being exposed to inner spaces of the light emitting cells without being covered by a phosphor layer of phosphor particles and the crystalline thin film.

16. A plasma display panel according to claim 15, wherein barrier ribs are disposed on the back panel, the barrier ribs being exposed to the inner spaces of the light emitting cells without being covered by any of the phosphor layers and the crystalline thin film.

17. A plasma display panel according to claim 16, wherein visible light reflection efficiency of the back panel is at least 85%.

18. A plasma display panel according to claim 16, wherein a reflecting area having a function for reflecting visible light is provided either on a surface of or inside the dielectric layer.

19. A plasma display device comprising:

the plasma display panel according to claim 16; and a driving circuit for driving the plasma display panel.

20. A plasma display panel according to claim 15, wherein barrier ribs are disposed on the back panel, the back panel having either the phosphor layers or the crystalline thin film on surfaces of the baffler ribs corresponding to the light emitting cells.

21. A plasma display panel according to claim 20, wherein visible light reflection efficiency of the back panel is at least 85%.

22. A plasma display panel according to claim 20, wherein a reflecting area having a function for reflecting visible light is provided either on a surface of or inside the dielectric layer.

23. A plasma display device comprising:

the plasma display panel according to claim 20; and a driving circuit for driving the plasma display panel.

24. A plasma display panel according to claim 15, wherein visible light reflection efficiency of the back panel is at least 85%.

25. A plasma display panel according to claim 24, wherein a reflecting area having a function for reflecting visible light is provided either on a surface of or inside the dielectric layer.

26. A plasma display device comprising:

the plasma display panel according to claim 24; and a driving circuit for driving the plasma display panel.

27. A plasma display panel according to claim 15, wherein a reflecting area having a function for reflecting visible light is provided either on a surface of or inside the dielectric layer.

28. A plasma display device comprising:

the plasma display panel according to claim 27; and a driving circuit for driving the plasma display panel.

29. A plasma display device comprising:

the plasma display panel according to claim 15; and a driving circuit for driving the plasma display panel.

30. A plasma display according to claim 1 further including a driving circuit for driving the plasma display panel.

31. A plasma display panel according to claim 30 wherein a color temperature of 10,000 K is provided when the plasma display panel is driven to display a white color by activating each of the plurality of light emitting cells.

32. A plasma display panel according to claim 1 wherein the crystalline thin film has a (111) crystal lattice.

33. A plasma display panel according to claim 1 wherein the crystalline thin film is made of an impact excitation phosphor material positioned in the plurality of light emitting cells with a surface exposed to the space between the front panel and the back panel.

34. A plasma display panel according to claim 33 wherein the impact excitation phosphor material is selected from one of $SnO_2$:Eu, ZnO:Zn and ZnS:Ag.

35. A plasma display panel comprising a front panel and a back panel facing each other, the plasma display panel having a plurality of light emitting cells in a space between the front panel and the back panel, wherein the back panel includes electrodes, and a crystalline thin film is disposed on the electrodes, with a reflecting area interposed therebetween, the reflecting area having a function for reflecting visible light to the front panel, the crystalline thin film comprising a thinned crystal made of a phosphor material.

36. A plasma display panel according to claim 35, wherein a surface of the reflecting area is formed in a concave and convex shape so as to enlarge an effective surface area, the surface being on a side facing the crystalline thin film.

37. A plasma display device comprising:

the plasma display panel according to claim 36; and a driving circuit for driving the plasma display panel.

38. A plasma display device comprising:

the plasma display panel according to claim 35; and a driving circuit for driving the plasma display panel.

39. A method of manufacturing a plasma display panel including a crystalline thin film forming step for forming a crystalline thin film on either one or both of a front panel and a back panel, the crystalline thin film comprising a thinned crystal made of a phosphor material, wherein in the crystalline thin film forming step, the crystalline thin film is formed through a vacuum process in a reduced pressure atmosphere, containing oxygen on the front panel by growing a thin film crystal using a vapor phase growth method.

40. A method of manufacturing a plasma display panel according to claim 39, wherein one of a vacuum evaporation method, a spattering method, and a CVD method is used in the crystalline thin film forming step.

41. A method of manufacturing a plasma display panel according to claim 39, the method including a step for forming the front panel, wherein the step for forming the front panel includes a sub-step for forming a protecting film, the sub-step for forming the protecting film and the crystalline thin film forming step are carried out successively without any step therebetween.

42. A method of manufacturing a plasma display panel according to claim 41, wherein the sub-step for forming the protecting film and the crystalline thin film forming step are carried out while the front panel is maintained so as not to be exposed to air.

43. A method of manufacturing a plasma display panel according to claim 39, wherein in the vacuum process of the phosphor film forming step, a part where the crystalline thin film is to be formed is heated.

44. A method of manufacturing a plasma display panel comprising:

a first step for forming a first phosphor layer on a front panel; and a second step for forming a second phosphor layer on a back panel, wherein one of the first step and the second step is a step for forming a crystalline thin film, and another is a step for forming a phosphor layer of phosphor particles, the crystalline thin film comprising a thinned crystal made of a phosphor material.

45. In an A-C type plasma display panel having a front substrate and a back substrate with address and display electrodes that provide images by discharges in a plurality of cells sustaining a plasma gas between the substrates, a dielectric protective film is provided over the electrodes to support wall charges, the improvement of increased luminous transmission efficiency comprising:

a first layer of a first phosphor material of a non-crystalline structure supported on the back substrate in the plurality of cells that is excited by ultraviolet rays to provide visible light; and a second layer of a second phosphor material of a crystalline structure that is supported on the front substrate with a visible light penetration efficiency of at least 85% wherein visible light emitted by the first layer is transmitted through the second layer and the second layer, in response to a discharge in an adjacent cell is excited to emit visible light.

46. The A-C type plasma display panel of claim 45 wherein the crystalline structure second layer is on the dielectric protective film and is an impact excitation type of phosphor material.

47. The A-C type plasma display panel of claim 46 wherein the crystalline structure second layer is thinner than the first layer and is covered by the dielectric protective film between the electrodes on the front substrate, the crystalline structure second layer is an ultraviolet ray excitation type phosphor material.

48. The A-Cy type plasma display panel of claim 45 wherein the crystalline structure second layer has lattice points and the first layer includes particles of phosphor material.

49. A plasma display panel comprising a front panel and a back panel facing each other, the plasma display panel having a plurality of light emitting cells in a space between the front panel and the back panel, wherein an area having a crystalline thin film included in the front panel, the area corresponding to at least a part of the light emitting cells, the crystalline thin film comprising a thinned crystal made of a phosphor material, wherein phosphor layers made of phosphor particles are disposed on the back panel and/or surfaces of barrier ribs at parts corresponding to the light emitting cells, the barrier ribs being disposed on the back panel.

50. A plasma display panel according to claim 49, wherein the thinned crystal is made of a phosphor material having a different composition from a phosphor material that is used for the phosphor layers.

51. A plasma display panel according to claim 50, wherein the thinned crystal is made of an impact excitation type phosphor material.

52. A plasma display panel comprising a front panel and a back panel facing each other, the plasma display panel having a plurality of light emitting cells in a space between the front panel and the back panel, wherein an area having a crystalline thin film with a (111) crystal lattice is included in at least one of the front panel and the back panel, the area corresponding to at least a part of the light emitting cells, the crystalline thin film comprising a thinned crystal made of a phosphor material.

53. A plasma display device comprising:

the plasma display panel according to claim 52; and a driving circuit for driving the plasma display panel.

54. A method of manufacturing a plasma display panel including a crystalline thin film forming step for forming a crystalline thin film on either one or both of a front panel and a back panel, the crystalline thin film comprising a thinned crystal made of a phosphor material, wherein in the crystalline thin film forming step, the crystalline thin film is formed through a vacuum process in a reduced pressure atmosphere, under a reducing atmosphere on the front panel by growing a thin film crystal using a vapor phase growth method.

55. A plasma display device comprising:

a plasma display panel including a front panel and a back panel facing each other, the plasma display panel having a plurality of light emitting cells in a space between the front panel and the back panel, wherein an area having a crystalline thin film is included in the front panel, the area corresponding to at least a part of the light emitting cells, the crystalline thin film comprising a thinned crystal made of a phosphor material, wherein phosphor layers made of phosphor particles are disposed on the back panel and/or surfaces of barrier ribs at parts corresponding to the light emitting cells, the barrier ribs being disposed on the back panel; and a driving circuit for driving the plasma display panel.

56. A plasma display panel according to claim 55, wherein the thinned crystal is made of a phosphor material having a different composition from a phosphor material that is used for the phosphor layers.

57. A plasma display panel according to claim 55, wherein the thinned crystal is made of an impact excitation type phosphor material.

58. A plasma display panel comprising a front panel and a back panel facing each other, the plasma display panel having a plurality of light emitting cells in a space between the front panel and the back panel, wherein an area having a crystalline thin film is included in at least one of the front panel and the back panel, the area corresponding to at least a part of the light emitting cells, the crystalline thin film comprising a thinned crystal made of a phosphor material, wherein the crystalline thin film is made of an impact excitation phosphor material positioned in the plurality of light emitting cells with a surface exposed to the space between the front panel and the back panel.

59. A plasma display panel according to claim 58 wherein the impact excitation phosphor material is selected from one of $SnO_2$:Eu, ZnO:Zn and ZnS:Ag.

60. A plasma display device comprising:

the plasma display panel according to claim 58; and a driving circuit for driving the plasma display panel.

* * * * *